US007559183B2

(12) United States Patent
Bell

(10) Patent No.: US 7,559,183 B2
(45) Date of Patent: Jul. 14, 2009

(54) PACKAGING DEVICE AND CONTAINER FOR SHEET OBJECTS

(75) Inventor: Malcolm Bell, Leeds (GB)

(73) Assignee: Money Controls Limited, Royton Oldham (GB)

( * ) Notice: Subject to any disclaimer, the term of this patent is extended or adjusted under 35 U.S.C. 154(b) by 439 days.

(21) Appl. No.: 10/580,758

(22) PCT Filed: Nov. 26, 2004

(86) PCT No.: PCT/GB2004/005009

§ 371 (c)(1),
(2), (4) Date: May 26, 2006

(87) PCT Pub. No.: WO2005/054055

PCT Pub. Date: Jun. 16, 2005

(65) Prior Publication Data

US 2007/0102439 A1 May 10, 2007

(30) Foreign Application Priority Data

Nov. 26, 2003 (GB) ..... 0327522.9

(51) Int. Cl.
*B65B 1/24* (2006.01)
*B65B 63/02* (2006.01)

(52) U.S. Cl. ..... 53/526; 53/58; 53/500; 53/131.1; 53/136.4; 206/565; 206/499; 206/807

(58) Field of Classification Search ..... 53/58, 53/500, 113, 523, 526, 131.1, 136.3, 136.4; 194/206, 207, 209; 271/34; 206/560, 565, 206/499, 807; 902/13; 209/534
See application file for complete search history.

(56) References Cited

U.S. PATENT DOCUMENTS 4,113,140 A * 9/1978 Graef et al. ..... 221/6

(Continued)

FOREIGN PATENT DOCUMENTS

DE 3931176 3/1991

(Continued)

OTHER PUBLICATIONS

International Preliminary Report on Patentability Mailed Jun. 8, 2006 in Counterpart Application PCT/GB2004/005009.

*Primary Examiner*—Paul R Durand
(74) *Attorney, Agent, or Firm*—Orrick Herrington & Sutcliffe, LLP

(57) ABSTRACT

A device (1) packages a stack of sheet objects such as banknotes (2) in a container (4) sandwiched between a frame (6) and the device's main body (5). Banknotes are fed through a first input port (3) to be stacked in the container. A closure member (9) is inserted through a second input port (10) and heat-sealed onto the container (4) when full. The container (4) is integrally moulded in a plastics material with inwardly hinged wings (19,20) that act as guide rails (23) for banknotes as they are fed towards opening (11) of the container by a drive mechanism the packaging device. The wings have castellations (24) that act as a stop to hold edges of banknotes (29) in stacked in the container by the drive mechanism. A printer (51) prints data concerning the stacked banknotes on the underside of the closure member (9). The packaged container is opened by a device that compresses it so that the closure member (9) bursts along a line of weakness (53).

51 Claims, 19 Drawing Sheets

U.S. PATENT DOCUMENTS

| | | | | |
|---|---|---|---|---|
| 4,313,601 | A * | 2/1982 | Graef et al. | 271/207 |
| 4,369,360 | A * | 1/1983 | Tsuji | 235/379 |
| 4,784,274 | A * | 11/1988 | Mori et al. | 209/534 |
| 5,411,249 | A * | 5/1995 | Zouzoulas | 271/181 |
| 6,076,826 | A * | 6/2000 | Gerlier et al. | 271/274 |
| 6,402,025 | B1 * | 6/2002 | Shepherd et al. | 235/379 |
| 6,550,221 | B1 * | 4/2003 | Neri | 53/399 |
| 6,922,973 | B1 * | 8/2005 | Hofmann et al. | 53/399 |
| 2002/0130778 | A1 | 9/2002 | Nicholson | |
| 2002/0158370 | A1 * | 10/2002 | Borst | 264/553 |
| 2004/0233618 | A1 * | 11/2004 | Ashurst et al. | 361/600 |

FOREIGN PATENT DOCUMENTS

| | | |
|---|---|---|
| EP | 0852279 | 7/1998 |
| EP | 1031949 | 8/2000 |
| EP | 1189106 | 3/2002 |
| EP | 1258842 | 11/2002 |
| GB | 2236143 | 3/1991 |
| WO | 9417274 | 8/1994 |
| WO | 94/17274 | 8/1998 |
| WO | 01/91065 | 11/2002 |

* cited by examiner

PACKAGING DEVICE AND CONTAINER FOR SHEET OBJECTS

RELATED APPLICATIONS

The present invention claims all rights of priority to PCT International Application No. PCT/GB2004/005009, filed on Nov. 26, 2004 and United Kingdom Application No. GB 0327522.9, filed on Nov. 26, 2003, both of which are hereby incorporated by reference.

FIELD OF THE INVENTION

This invention relates to a packaging device and a container for sheet objects that have an attributable monetary value, for example paper money such as banknotes or like promissory notes.

BACKGROUND OF THE INVENTION

Hitherto, banknotes have been counted in note counting machines and wrapped in stacks with paper bands. Also, vacuum packing machines have been used to pack stacks of banknotes in airtight bags that are evacuated of air and sealed. Banknotes packaged in this way can be transported readily without the risk of the individual stacks being pilfered. However vacuum packing machines are expensive and normally used only for processing large volumes of banknotes.

For smaller volume applications, for example in retail operations, devices such as our WACS 5 (World Acceptor Cassette System) note bill and bar coded ticket/coupon acceptor may be used, which has a cassette stacking system. The cassette comprises a metal box that receives validated bank notes or the like from a note acceptor. The cassette can store of the order of 500 street-grade banknotes. The cassette may be removed by an operator and taken to a secure location where it is unloaded, for onward transmission of the banknotes e.g. to a bank. A problem with the cassette system-is that it can be opened during transport and runs the risk of pilfering. Furthermore, the cassette provides no ready indication that it has been opened and that pilfering may have occurred.

SUMMARY OF THE INVENTION

According to the invention from one aspect there is provided a packaging device for packaging a stack of sheet objects that have an attributable monetary value in a container, comprising: an output port for supplying sheet objects to be stacked in the container, a docking mechanism to receive the container, so that an opening in the container can receive the sheet objects from the output port, a drive mechanism for driving the sheet objects to the output port, and for supplying the sheet objects through the opening into the container to be stacked therein, and a sealing device to seal a closure member onto the container opening whilst held by the docking mechanism so as to seal the stacked sheet objects within the container such that the sealed container cannot be opened without rendering it subsequently unusable for packaging sheet objects in the packaging device.

In another aspect, the invention provides a container for packaging sheet objects with an attributable monetary value, comprising an opening to receive the sheet objects, a base, sidewalls extending towards the opening from the base, support rails coupled to the side walls on opposite sides of the opening, past which in use the sheet objects resiliently deform when placed in the container in a stacked configuration, and a spring in the base operable to urge stacked sheet objects in the container against the support rails, the container being configured to receive a closure member sealed thereto over the opening so that the container cannot be reused for stacking sheet objects once opened.

Thus by means of the invention, sheet objects such as banknotes can be stacked in the container which is provided with a sealed closure member so that once opened, the container cannot be reused for packing sheet objects. The container thus provides a clear indication as to whether the contents have been tampered with. Thus, the container may be disposable and need not be returned for re-use as with a conventional cassette, which is a relatively expensive item.

Furthermore the packaging device according to the invention may include a printer to print data relating to sheet objects supplied into the container and the printing may be performed onto a side of the closure member but after sealing is on the inside of the container. This provides a tamperproof configuration in which data corresponding to the number and denomination of sheet objects can be securely associated with the contents of the container.

The invention also indudes an improved device for removing sheet objects from the container, which includes a support for the container around the periphery of its opening, a ram to apply a force to the base to drive it towards the opening and to s collapse the side walls and cause the sheet objects to burst open the closure member so that the objects move out of the container through the opening.

BRIEF DESCRIPTION OF THE DRAWINGS

In order that the invention may be more fully understood an embodiment thereof will now be described by way of example with reference to the accompanying drawings in which.

DETAILED DESCRIPTION

Figure 1:
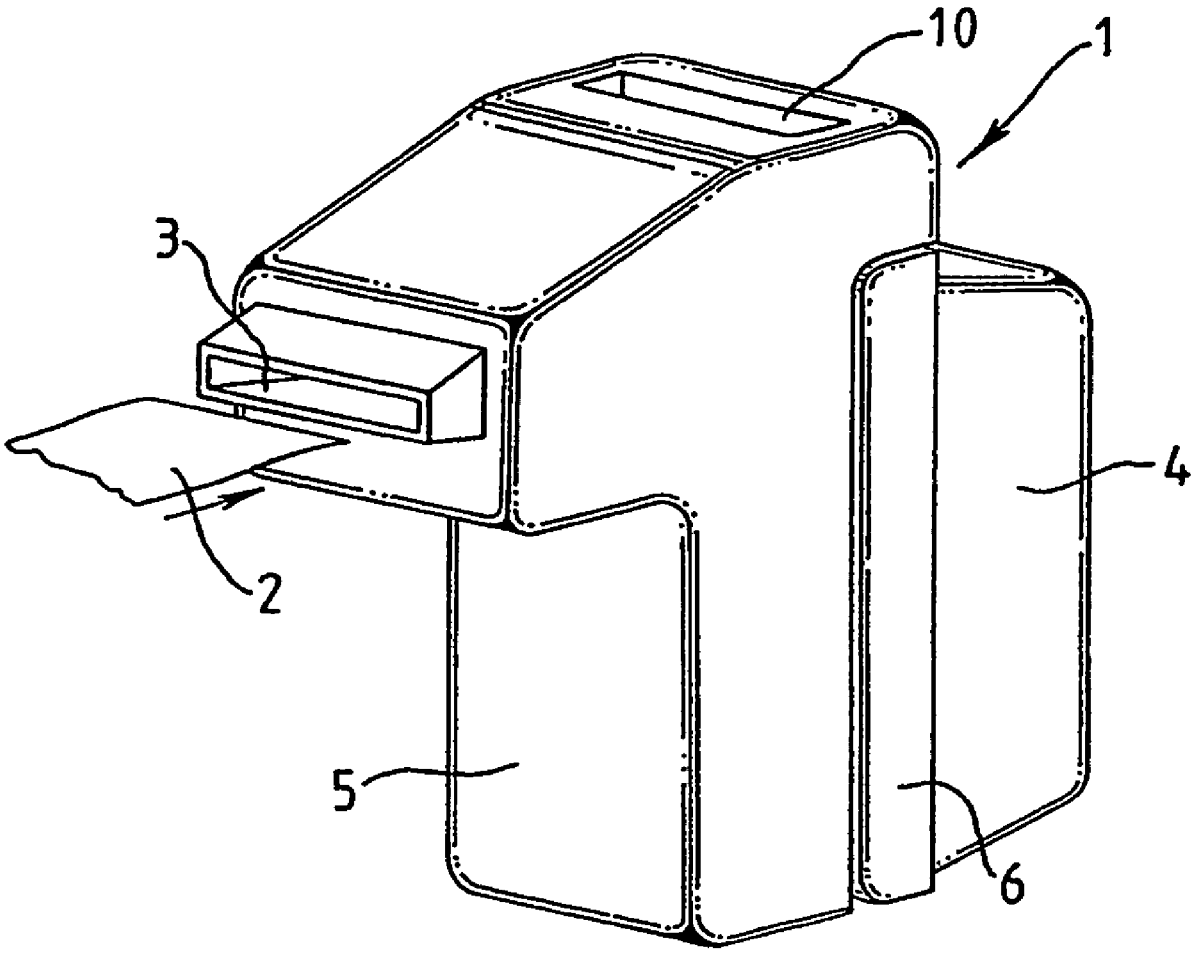
FIG. 1 is a schematic perspective view of a packaging device and associated single use container in accordance with the invention, in a closed configuration with the container fitted ready for use.

The example of the invention illustrated in the drawings is for packaging banknotes and as used herein, the term "banknote" means a promissory note especially from a central bank or other governmental organisation payable to the bearer on demand for use as money, also known as "paper money" and in the USA as "currency" or a "bill".

Referring to FIG. 1, a packaging device 1 is configured to receive individual banknotes 2 through an input slot 3 and stack them in a removable container 4. The packing device 1 may be mounted at a point of sale in a retail outlet, for example at a checkout in a supermarket so that banknotes can be packaged in container 4 and then transported securely to a remote location such as a cashier's office.

The packaging device 1 comprises a main body 5 and a frame 6 mounted on the main body to receive the container 4. The frame 6 is hinged on the main body 5 in this example, so that it can be moved between a closed position shown in FIG. 1 to an open position shown in FIG. 2, to act as a docking mechanism that allows the container 4 to be inserted and removed between the frame and the main body. The container 4 is a generally rectangular in configuration to be described in more detail hereinafter, with a peripheral lip 7. The frame 6 defines an output port 8 through which the container 4 protrudes as shown in FIG. 1, with its lip 7 sandwiched between the main body 5 and the frame 6.

Figure 2:
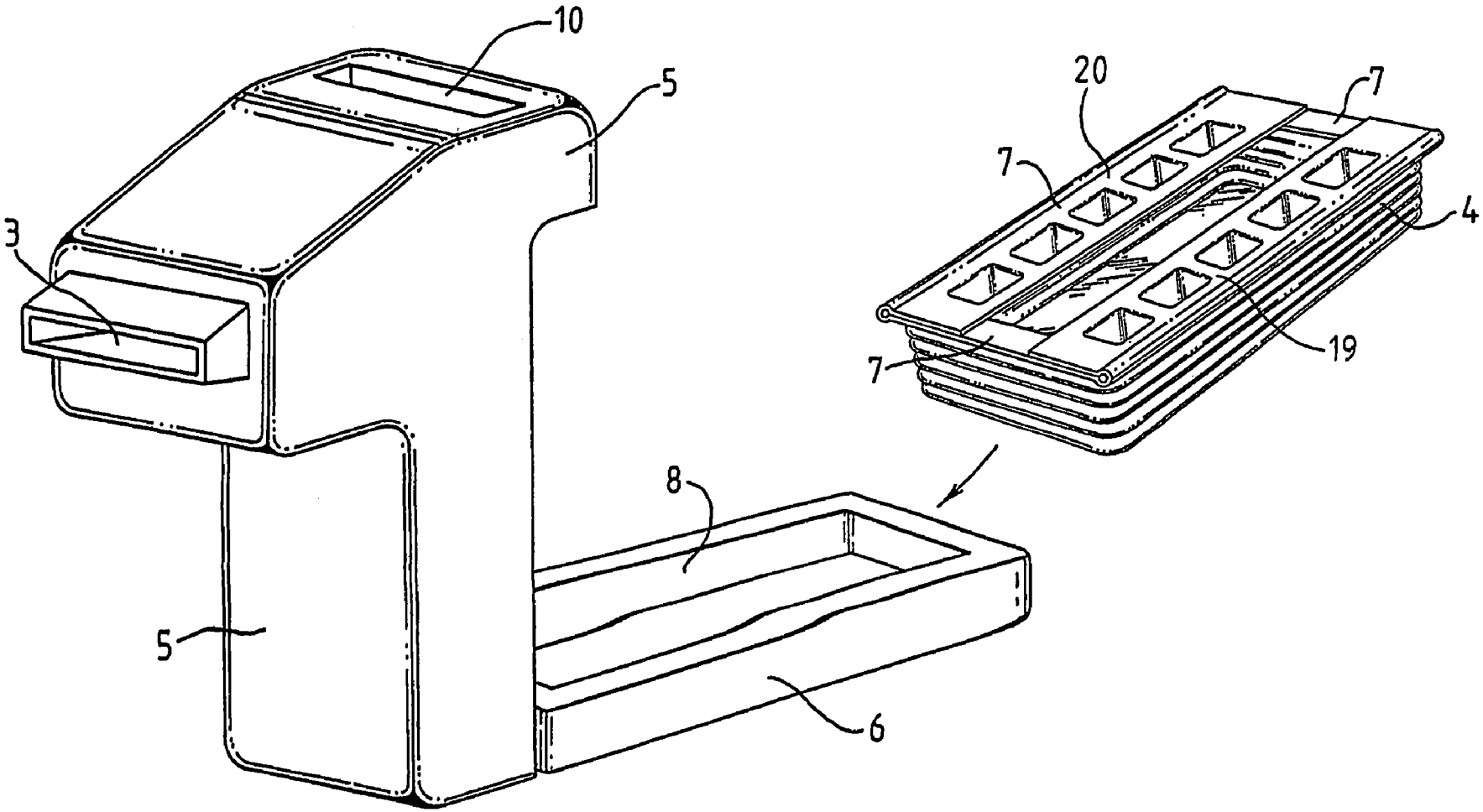
FIG. 2 corresponds to the view of FIG. 1 but with the device open to receive the container, prior to use.
Figure 3:
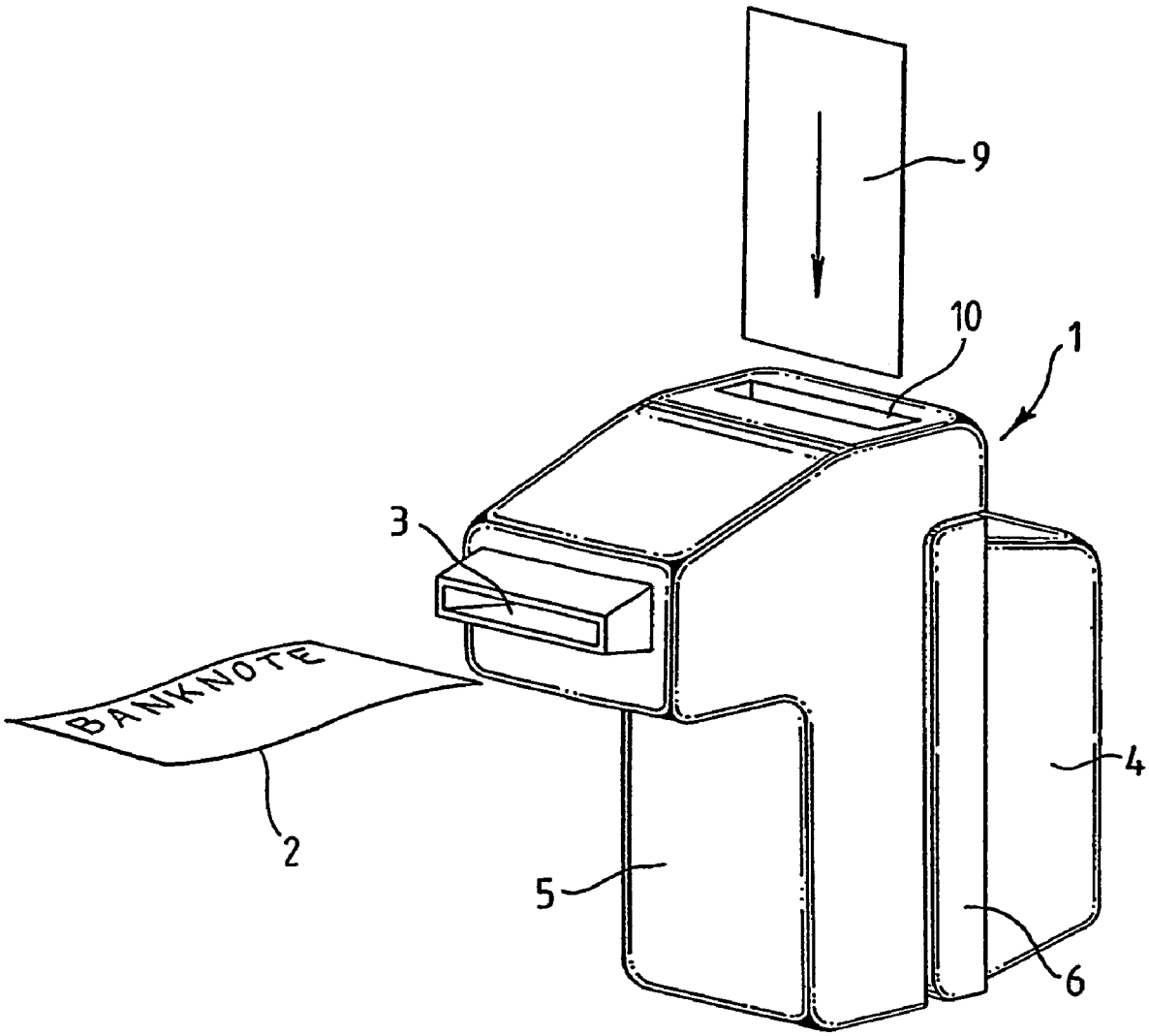
FIG. 3 corresponds to FIG. 1 and shows the insertion of a closure member that is sealed to the container.

Referring to FIG. 3, when the container becomes full of banknotes 2, a closure member in the form of a sealing card 9 is inserted through a second input port 10 in the main body 5, to be heat sealed onto the container 4. Thus, when the frame 6 is opened as shown in FIG. 2, a sealed container is provided containing the banknotes for transport to the cashier's office.

Figure 4:
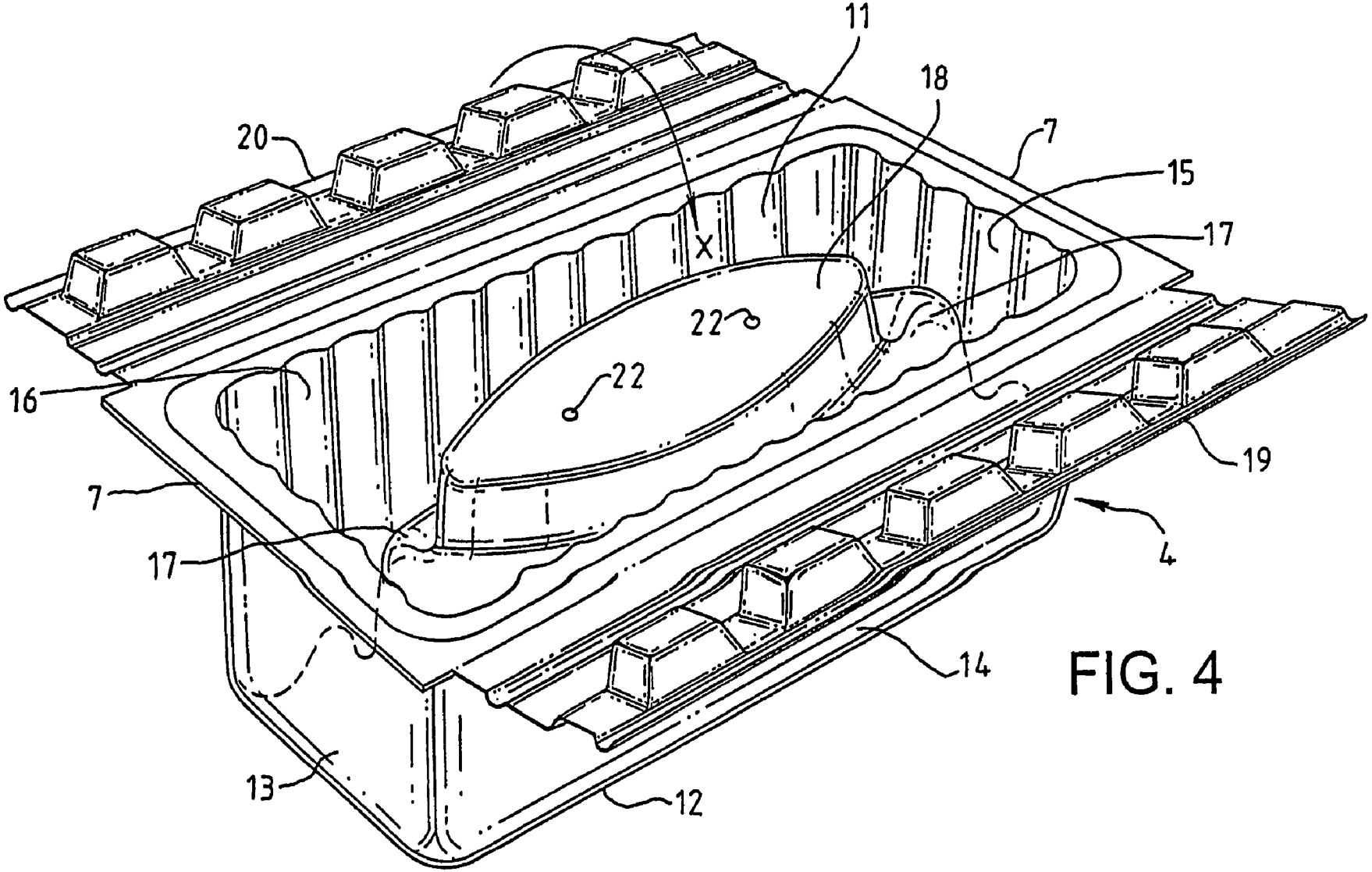
FIG. 4 is a schematic perspective view of first example of a container.

Referring to FIG. 4, the container 4 is manufactured as a one piece moulding of a thermoplastics material and comprises a generally rectangular opening 11 bounded by the lip 7, a base 12, and sidewalls 13, 14, 15, 16 that extend from the base to the opening and the lip 7. The sidewalls 13, 14, 15, 16 are corrugated to provide rigidity.

The dimensions of the opening 11 are chosen to allow the insertion of a particular denomination of banknote, with the sidewalls 14, 16 being longer than sidewalls 13, 15.

The base 12 is moulded to include corrugations 17 that are disposed between a central, base support region 18 and the sidewalls 13-16. In this example, the base support region 18 is elliptical but as will be evident hereinafter, other shapes can be used. The corrugations 17 act as a compression spring to urge the base support region 18 towards the opening 11 as successive banknotes are inserted into the container.

Support rails in the form of elongate, castellated wings 19, 20 are hingedly coupled to the lip 7 along the long sides of the container 4. The wings 19, 20 are initially in the configuration shown in FIG. 4 and as a result, a plurality of containers 4 can be stacked one within the other, enabling a supply of containers to be easily delivered and stored adjacent the packaging device at the point of sale, ready for use.

In order to prepare a container 4 for use in the packaging device 1, a relatively rigid rectangular platen 21 (not shown in FIG. 4 but illustrated in FIG. 8) is placed on the base support region 18. The platen 21 may comprise a moulded plastics member that couples to the base support region 18 by cooperating pegs and receptacles 22, or the platen 21 may simply be a rectangular piece of cardboard or similar material that rests on the base support region 18. The platen 21 extends to the sidewalls of the container 4 to support the banknotes. Thereafter, the wings 19, 20 are hinged inwardly from the position shown in FIG. 4, in the direction of arrows X. As explained in more detail hereinafter, the wings 19, 20 when folded inwardly, act as guide rails to allow banknotes to be passed along them for insertion into the container 4 through the opening 11.

Figure 5:
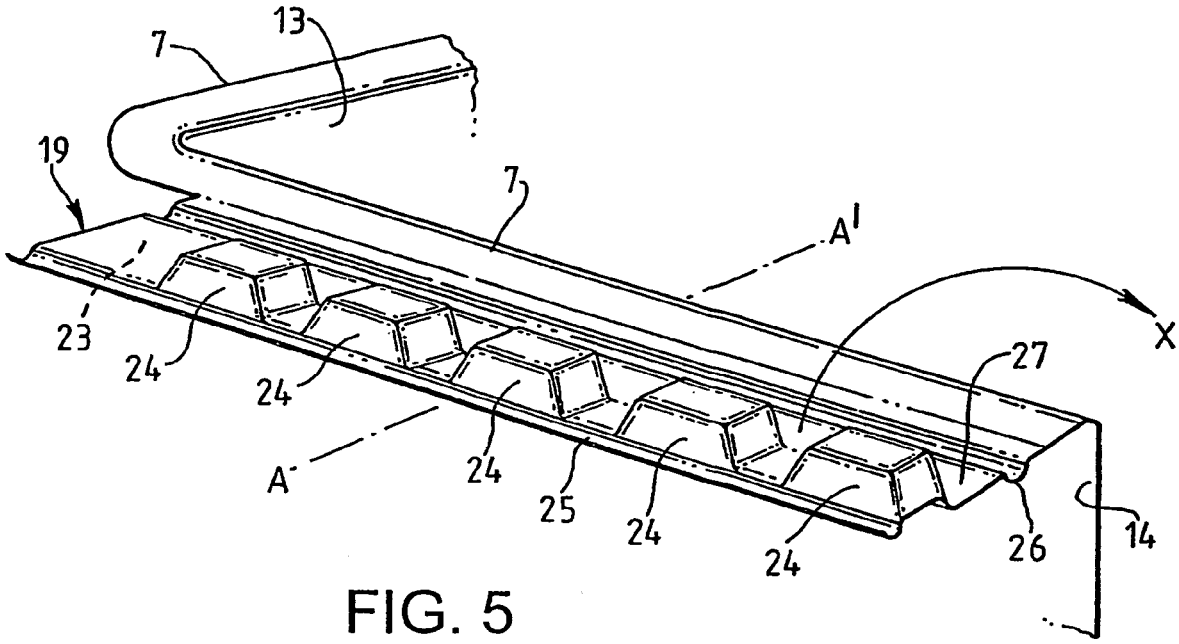
FIG. 5 is partially broken away perspective view of the container with one of its support rails in an open position.
Figure 6:
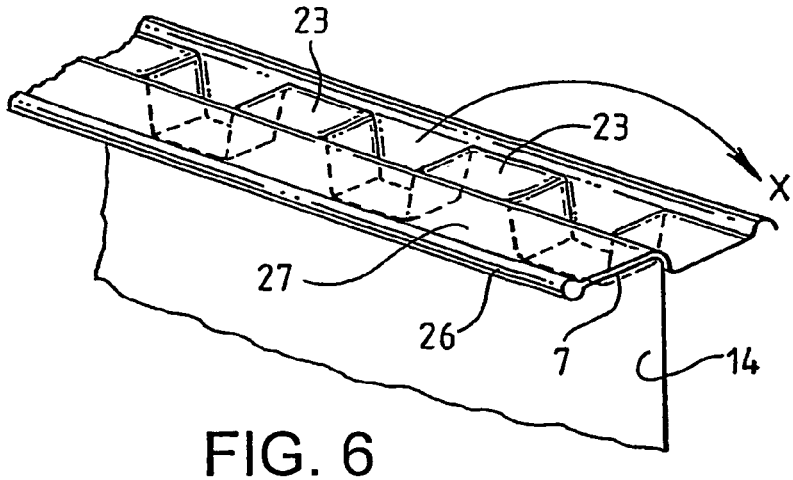
FIG. 6 corresponds to FIG. 5 but with the support rail in a closed position.

The wing 19 is shown in its initial, outwardly extending position in FIG. 5 and its inwardly folded position in FIG. 6. The wing 19 comprises a main guide surface 23 formed with a series of indentations that give rise to castellations 24, an outer lip 25, a hinge line 26 and a coupling surface 27 that connects the main guide surface 23 to the hinge line 26.

Figure 7A:
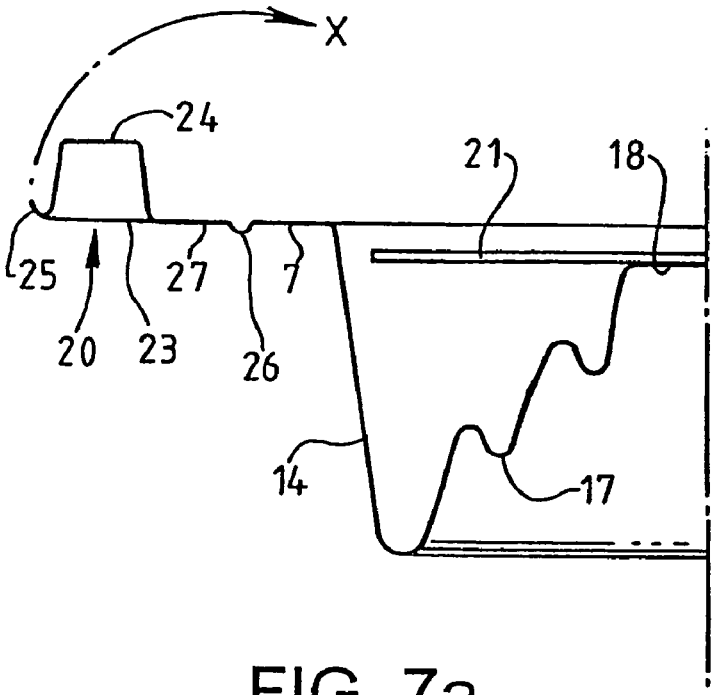
FIG. 7*a* is a partial sectional view of one side of the container when empty taken along the line A-A' of FIG. 5 with the support rail in the open position.
Figure 7B:
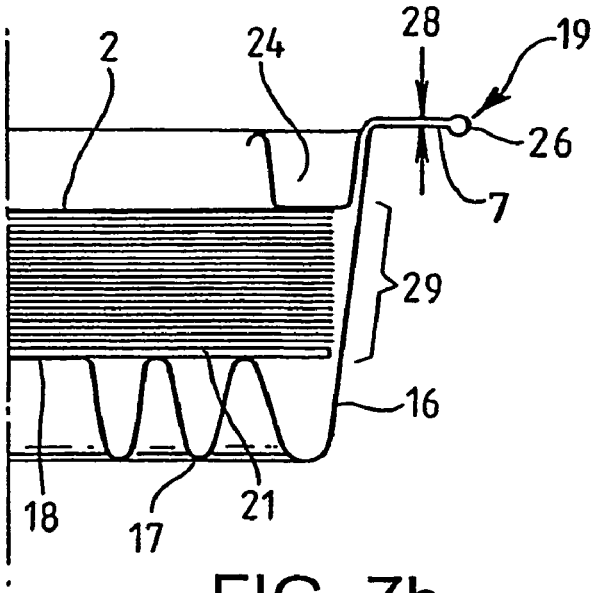
FIG. 7*b* is a partial sectional view of the other side of the container when full of banknotes, taken along the line A-A' of FIG. 5 with the support rail in the open position.

When the wings 19, 20 are folded inwardly in the direction of arrow X, and the container 4 is inserted into the packaging device 1, the coupling surface 27 is welded to the lip 7 by the packaging device 1 in the region 28 shown in FIG. 7*b* after having been filled with banknotes. In FIG. 7*a*, the wing 20 is shown in its initial, outwardly extending position, with no banknotes 2 in the container and with the spring corrugations 17 in their initial, uncompressed state. It will be understood that the wing 19 (not shown in FIG. 7*a*) will be in a similar configuration to wing 20. FIG. 7*b* illustrates the configuration when the container 4 has been filled with a stack 29 of banknotes 2. In this situation, the platen 21 has been compressed downwardly to accommodate the stack 29 of banknotes thereby compressing the corrugations 17 in the base of the container 4. The wing 19 has been hinged inwardly in the direction of arrow X and welded in region 28 against lip 7 so that the castellations 24 provide a downwardly depending stop region to hold the stack 29 of banknotes within the container. It will be understood that the wing 20 (not shown in FIG. 7*b*) will be similarly welded against lip 7.

Figure 8:
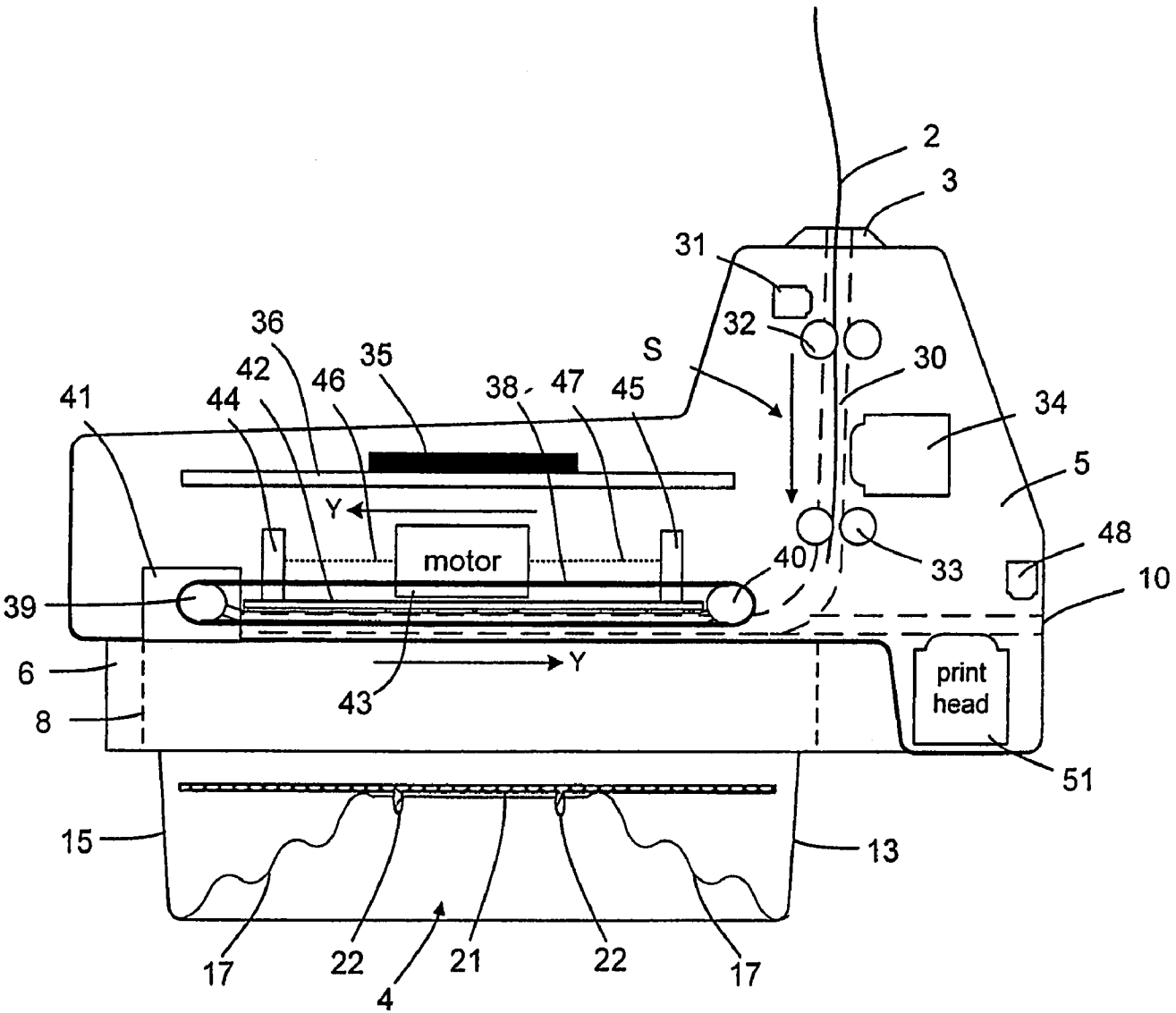
FIG. 8 is a longitudinal, sectional view of the packaging device with the container empty.

The way in which the packaging device 1 fills the container with banknotes will now be described in more detail. Referring to FIG. 8, a cross sectional view of the packaging device is shown, with the container 4 received in frame 6, empty and ready to receive banknotes. The wings 19, 20 of the container 4 have been folded inwardly into the position shown schematically in FIG. 2, and are clamped in this position between the main body 5 and the frame 6.

The main body 5 includes an input path 30 that extends from the first input port 3 through a banknote sensing station S, to the output port 8 in frame 6. When the banknote 2 is inserted into the first input port 3 it is detected by an optical sensor 31 that activates driven roller pairs 32, 33 to drive the banknote 2 past a validation sensor arrangement 34 at the sensing station S, coupled to validation circuitry 35 mounted on a printed circuit board 36. The validation sensor arrangement 34 and associated circuitry 35 may correspond to our Ardac technology described in U.S. Pat. No. 4,348,656. The validation sensor arrangement 34 and circuitry 35 can sense the acceptability, number and denomination of banknotes that enter the input port 3. In the event that the banknote 2 is determined to be a true banknote as opposed to a fraud by the sensor arrangement 34 and associated circuitry 35, the drive roller pairs 32, 33 transport the banknote 2 towards the output port 8. Otherwise, the roller pairs 32, 33 are driven in reverse so that the banknote 2 is ejected from the input port 3.

Figure 9A:
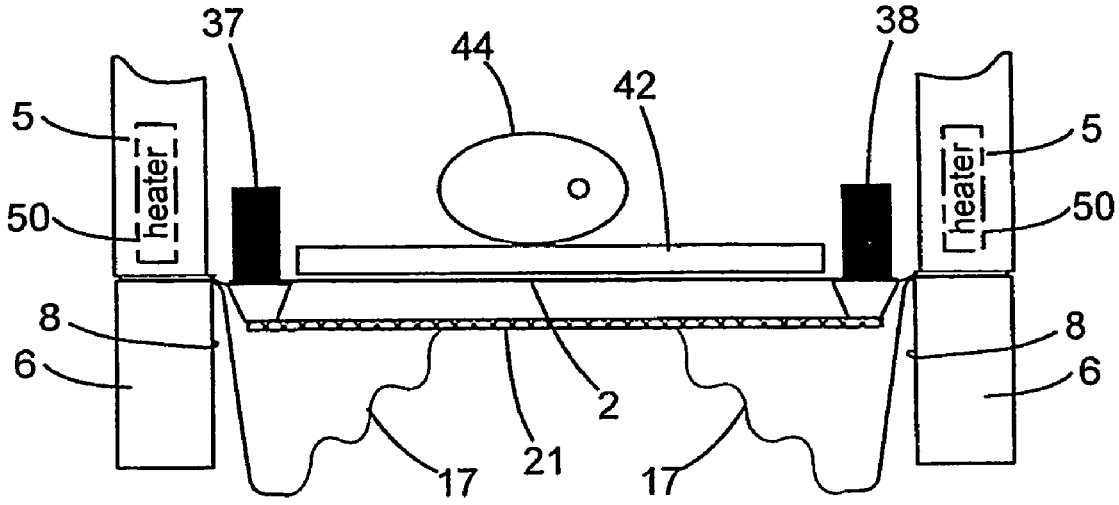
FIG. 9*a*-9*d* are views of the packaging device in transverse section illustrating operation of the drive mechanism to fill the container.

Assuming that the banknote 2 is acceptable, it is passed by the rollers 32, 33 towards a banknote drive mechanism, which in this example includes a pair of drive belts 37, 38 shown more clearly in FIG. 9*a*, which engage longitudinal side edges of the banknote and move it into alignment with the output port 8. Considering the belt 38 in more detail, it extends between pulleys 39, 40 which are driven by a motor 41 in the direction of arrows Y such that the banknote is drawn by the belts 37, 38 such that its major face moves along the input path until it becomes aligned with the output port 8.

The banknote drive mechanism also includes a plunger 42 in the form of a rigid plate that is mounted for movement downwardly between the belts 38,39 so as to drive the banknote 2 into the container 4. To this end, a motor 43 drives elliptical cams 44, 45 through a drive train 46, 47 illustrated schematically in dotted outline. In use, the cams 44, 45 rotate in the direction of arrow Z (shown in FIG. 9*b*) to drive the plunger 42 together with the banknote 2, into the container 4 through the opening 11, in a direction perpendicular to the plane of the banknote when it arrives at the opening 11 along the input path 30.

Figure 9B:
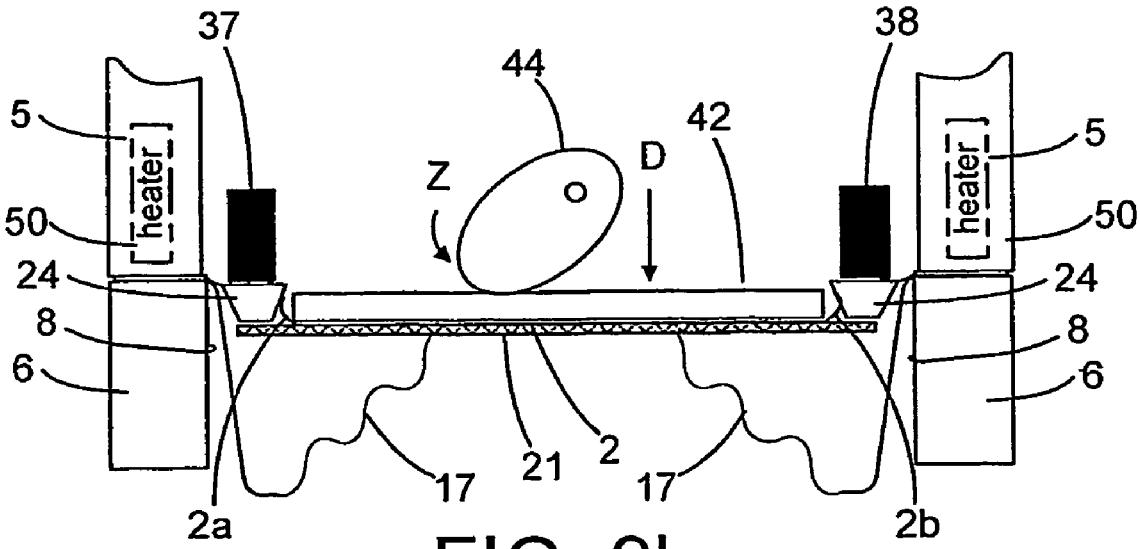

This process is shown in more detail in FIGS. 9*a*-9*d*. Referring to FIG. 9*a*, the banknote 2 is driven by belts 37, 38 along the main guide surfaces 23 of the inwardly folded wings 19, 20. The main guide surfaces 23 act as rails to support the longitudinal side edges of the banknote 2. When the banknote becomes aligned with the output port 8 in frame 6, the motor 43 is operated to rotate the cams 44, 45 as shown in FIG. 9*b*. As a result, the plunger 42 is moved downwardly in the direction of arrow D so that the belts 37, 38 are moved downwardly into the container past the wings 19, 20. Side edges 2*a*, 2*b* of the banknote deform so that they withdraw from the main guide surfaces 23 as the plunger 42 moves downwardly past the castellations 24, and the entire banknote 2 is moved into the container 4. As the cams 44, 45 continue to rotate, the plunger 42 and the banknote 2 are driven downwardly against the platen 21, such as to compress the spring 17, thereby allowing the side edges 2*a*, 2*b* of the banknote to lie flat and become disposed underneath the castellations 24.

Figure 9C:
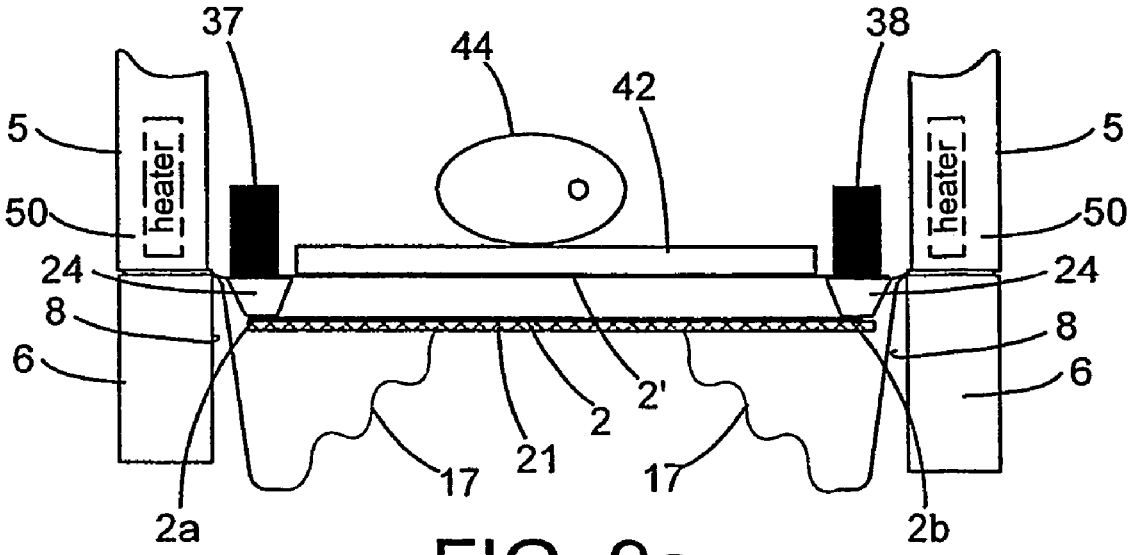

The cams 44, 45 are then rotated to their initial position ready to engage the next banknote 2' shown in FIG. 9*c*. Thus, the banknote 2 is inserted into the container 4 and it held therein by the compressive force of spring 17, against the castellations 24, which act as stop regions to hold the banknote in the container 4.

Figure 9D:
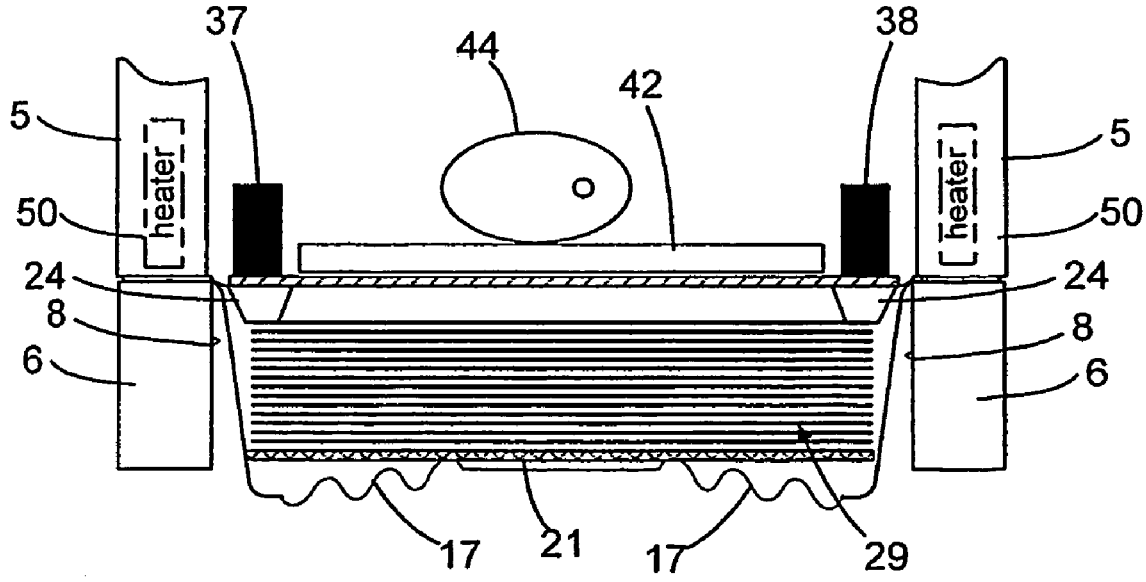

Successive banknotes are inserted into the container to form the banknote stack 29 shown in FIG. 9*d*, with the uppermost banknote being held under the castellations 24.

Figure 10:
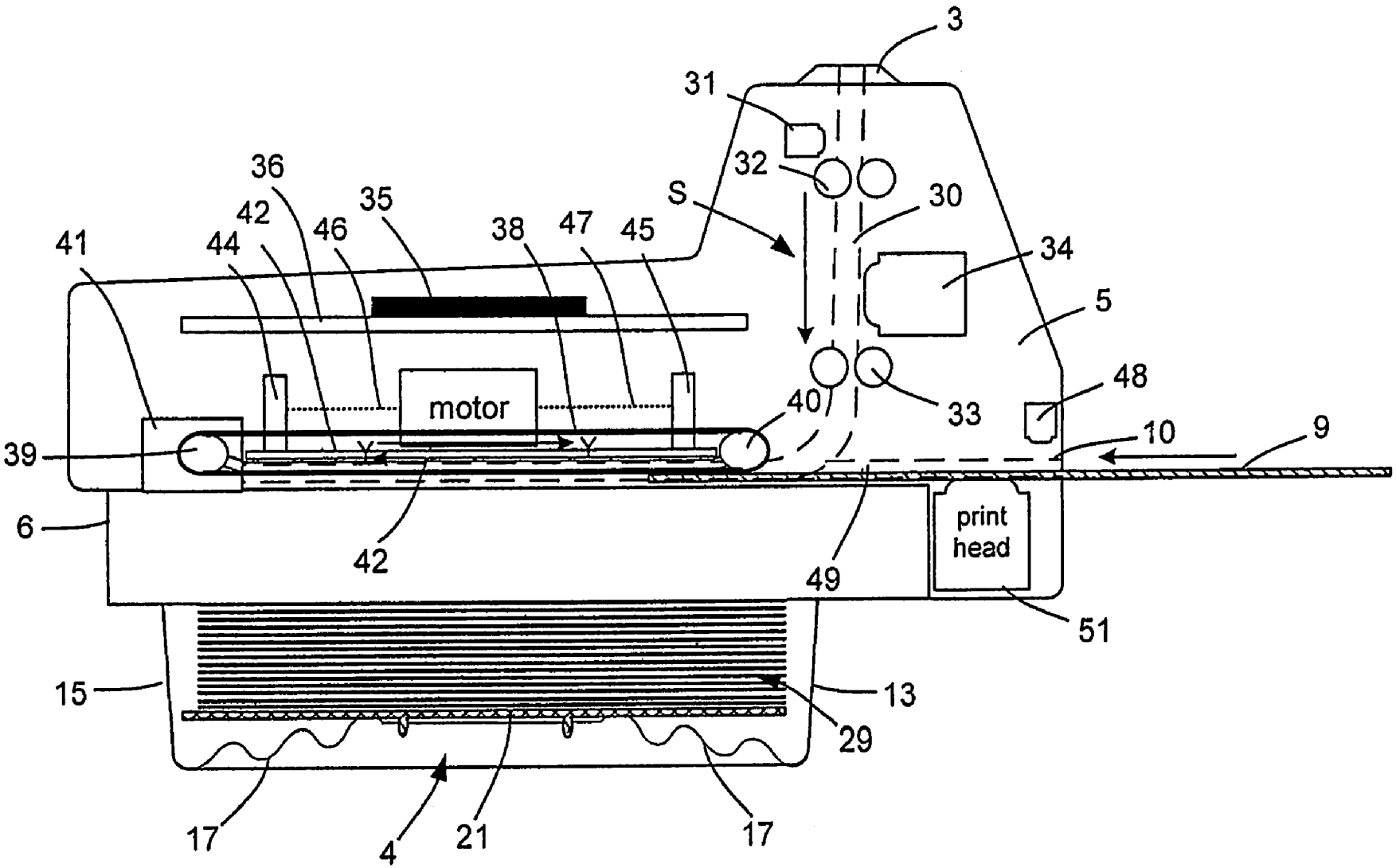
FIG. 10 corresponds to FIG. 8 but with the container full.

FIG. 10 shows the stack 29 in the container 4, with the platen 21 having been moved downwardly. The compressive force of spring 17 urges the stack 29 upwardly against the castellations 24 to hold the banknotes securely within the container.

When the container 4 is full, and operator inserts the closure member 9 through the second input port 10. The closure member 9 comprises an optically transparent or translucent sheet of plastics material. The closure member 9 is detected by an optical sensor 48 and moves along a closure member inlet path 49 that extends into the input path 30 for banknotes, so as to become engaged with and driven by the drive belts 37, 38 until it becomes aligned with the output port 8, in a similar manner to the banknotes during the previously described banknote stacking process. The closure member 9 thus becomes positioned over the inlet 11 of the container 4 with the side edges of the closure member 9 extending over the main guide surfaces 23 of the wings 19, 20 on the longer sides of the container, and also over the lip 7 on the shorter sides 13, 15 of the container. As shown in FIG. 9*d*, the main body 6 of the packaging device includes electrical heaters 50. In use, when the closure member 9 becomes aligned with the opening 11 of the container, the heaters 50 are switched on so as to heat seal the closure member 9 onto the wings 19, 20 and also to weld the wings themselves onto the rim 7 of the container i.e. to produce the weld 28 shown in FIG. 7.

As shown in FIG. 10, the main body 5 includes a print head 51 operable to print data on the underside of the closure member 9 so that when sealed onto the container 4, the printed data is within the container and cannot be altered except by opening it. The print head 51 is operable to print in a mirror image so that the data can be read normally through the transparent closure member 9 from outside the container 4. The circuitry 35 is operable to collate data concerning the number and denomination of banknotes that have been stacked in stack 29 in the container 4 and this data can be printed on the underside of the closure member 9 using the print head 51.

After the sealing of the closure member 9 on the container 4, the frame 6 can be opened as shown in FIG. 2 and the sealed container can be removed and transported to another location, for example to the cashier's office. The resulting packaged banknotes cannot readily be tampered with during transport because the closure member 9 is heat sealed to the container 4 protecting its contents. If the sealed container 4 is opened, this is readily apparent and the container cannot be subsequently reused in the packaging device. Thus, the risk of fraud is materially reduced. Also, the printing of data corresponding to the contents of the container on the inside of the closure member means that the printed indicia cannot readily abraded or otherwise altered.

Figure 11:
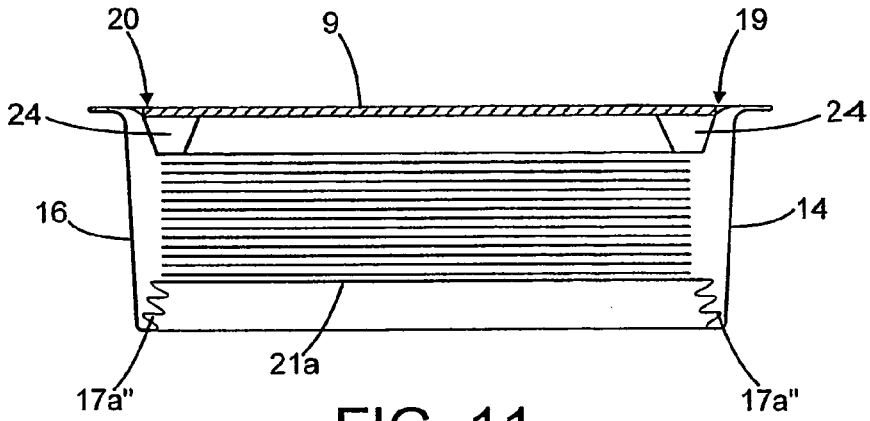
FIG. 11 is a transverse section of another embodiment of the container.
Figure 12:
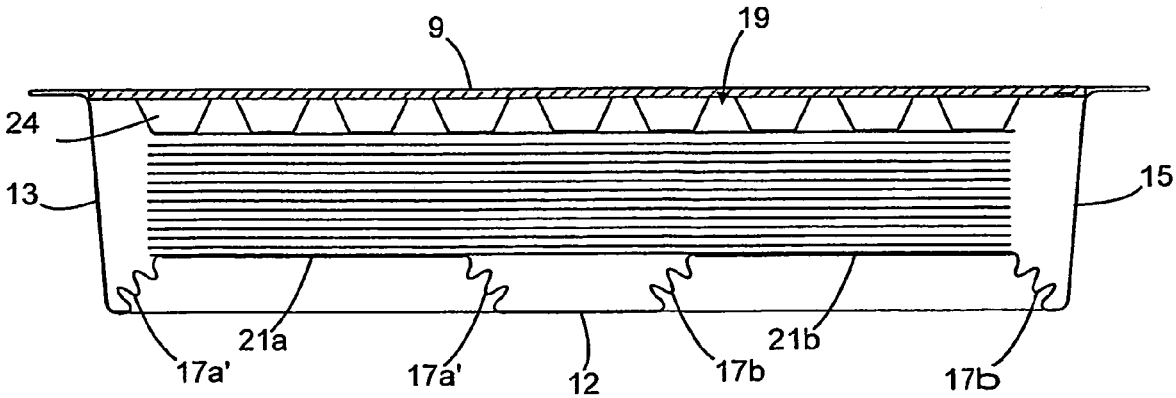
FIG. 12 is a longitudinal section of the container shown in FIG. 11.
Figure 13:
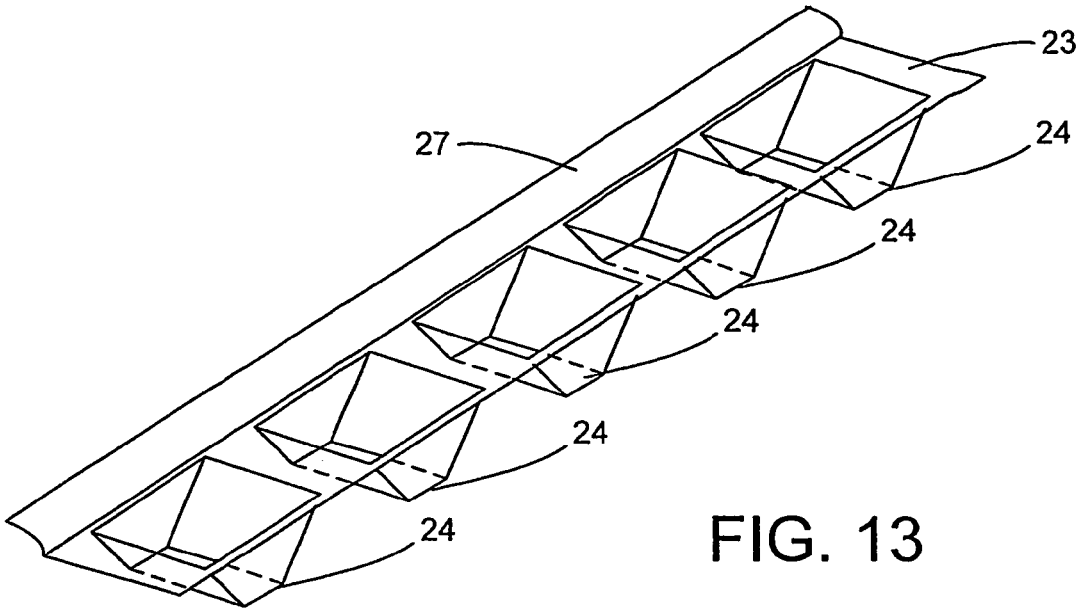
FIG. 13 is a perspective view of a support rail of the container of FIGS. 11 and 12.

FIGS. 11 to 14 illustrate a modified version of the container 4, which does not have a separate platen 21. In the container of FIG. 4, the platen 21 provides a rigid support for the relatively flexible banknotes as they become stacked in the container so that side edges of the banknotes can be reliably abutted against the undersides of the castellations 24. Without the relatively rigid platen 21, the relatively flexible banknotes may tend to curve around the base support region 18 and the spring region 17 in a domed configuration such that the banknotes are not reliably held on the undersides of the castellations 24. In the container shown in FIG. 11 to 14, the platen is formed integrally in two parts 21*a*, 21*b* with the base 12 of the container 4. As shown in FIG. 11, the platen 21*a* extends substantially the entire width of the container 4 so that the stack 29 of banknotes within the container is supported across the entire width of the banknotes by the relatively rigid platen 21*a*. The corrugated regions 17*a* around the platen 21*a* give rise to an integral compression spring with the main compressive force being given by regions 17*a*' shown in FIG. 12 and the longitudinal portions 17*a*" providing less of a spring effect. The platen region 21*b* is configured in a similar manner with surrounding integral springs 17*b*.

Figure 14:
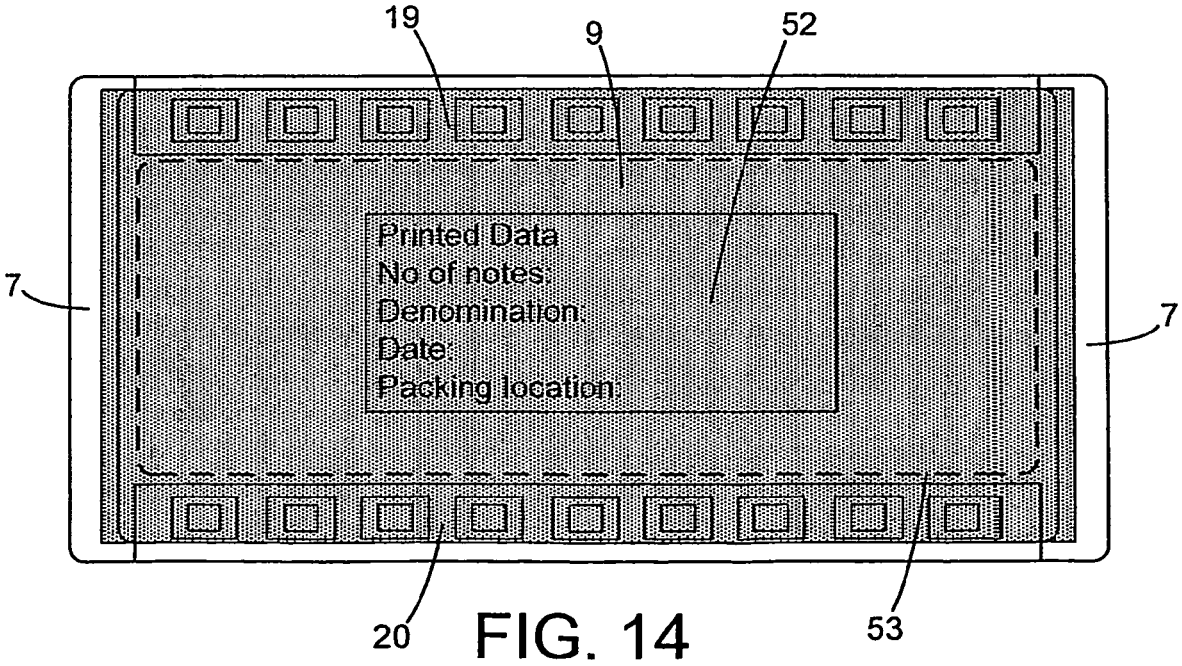
FIG. 14 is a top plan view of the container shown in FIGS. 11 and 12.

FIG. 14 illustrates the container 4 in plan view with the closure member 9 heat sealed onto the wings 19, 20 and the flange 7. Printed data 52 on the underside of the closure member 9 has been printed thereon by means of the print head 51 shown in FIG. 8.

The closure member 9 includes a line of weakness 53 to facilitate opening the container 4 when filled with banknotes. The closure member 9 can be manually depressed downwardly in the centre thereof so as to cause the closure member 9 to tear along the line of weakness 53. The contents can then be removed.

It will be understood that according to the invention, the container 4 cannot be reused for packaging banknotes in the packaging device 1 once the container has been opened, providing a clear visual indication of whether the packaging device has been tampered with after closure. Moreover, when opened, the data printed on the closure member 9 can be used to verify the contents of the container 4.

Figure 15:
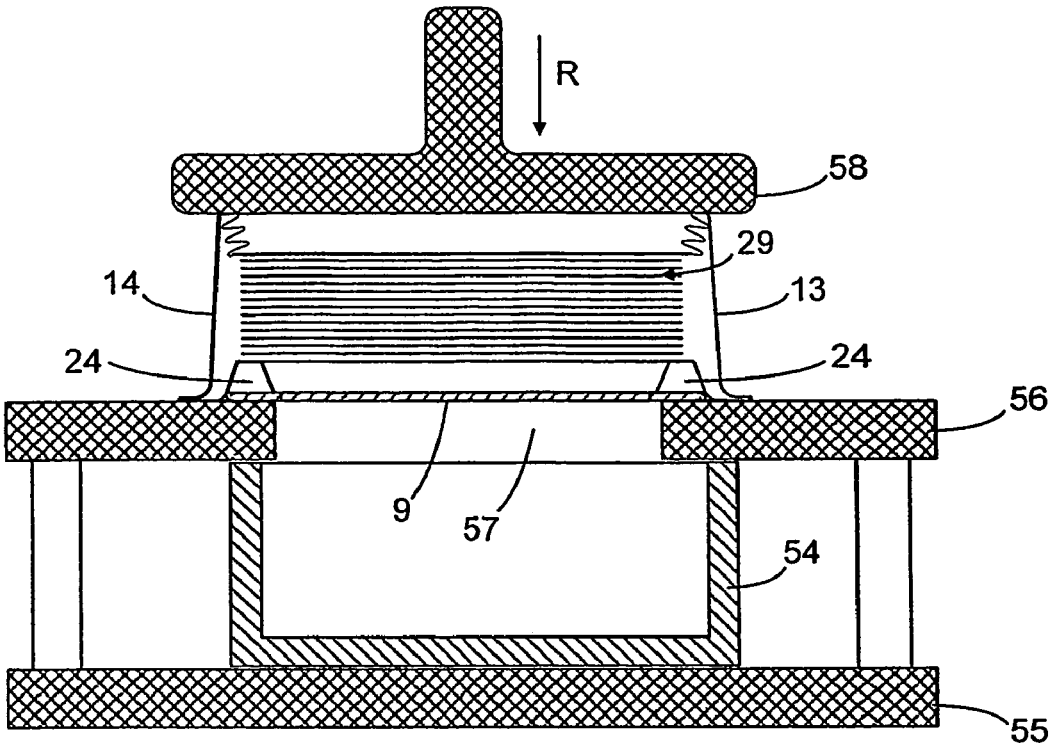
FIG. 15 is a sectional view of a container emptying device for emptying the contents of the container, ready for use.
Figure 16:
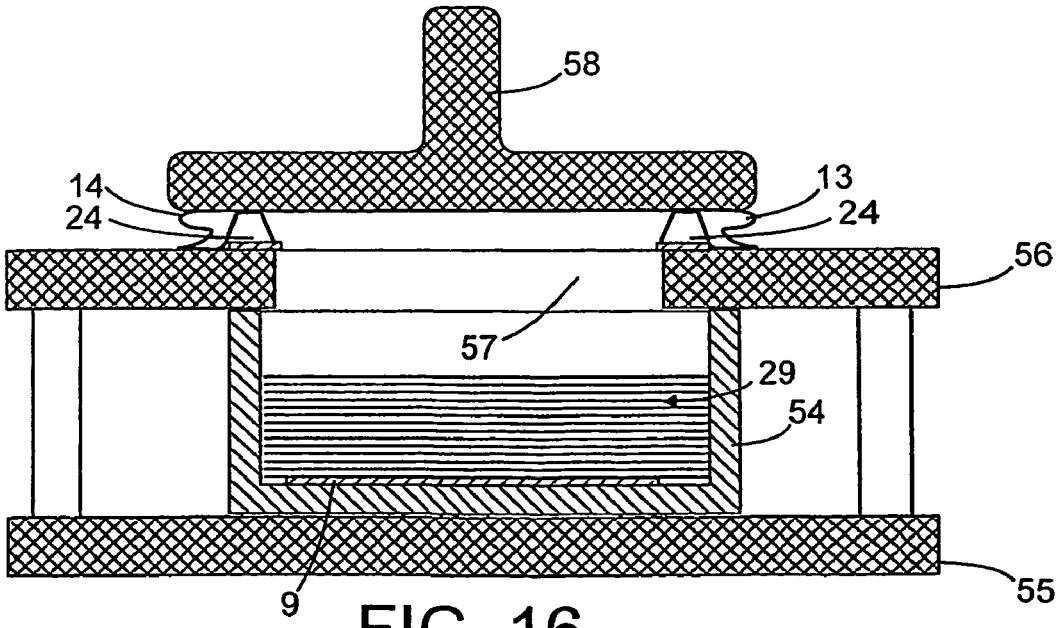
FIG. 16 is a sectional view of the emptying device after use.

The process of opening the container can be automated by means of a device illustrated in FIGS. 15 and 16. The device empties the contents of the container 4 into a tray 54 received on a support 55 beneath a platform 56 that includes a release aperture 57 with dimensions corresponding to the opening 11 of the container. In use, the container 4 is placed upside down with opening 11 coextensive with the release aperture 57. A ram 58 is operated downwardly in the direction of arrow R with sufficient force to collapse the sidewalls 13, 14, 15,16 of the container 4 and press the stack 29 of banknotes against the closure member 9, causing it to burst along the line of weakness 53. Continued movement of the ram 58 in the direction of arrow R causes the banknotes to deform past the castellations 24 and drop into the tray 54 as shown in FIG. 16, together with the printed closure member 9. The tray can then be removed from the device. The ram 58 is released and the remains of the container 4 are discarded.

Figure 17:
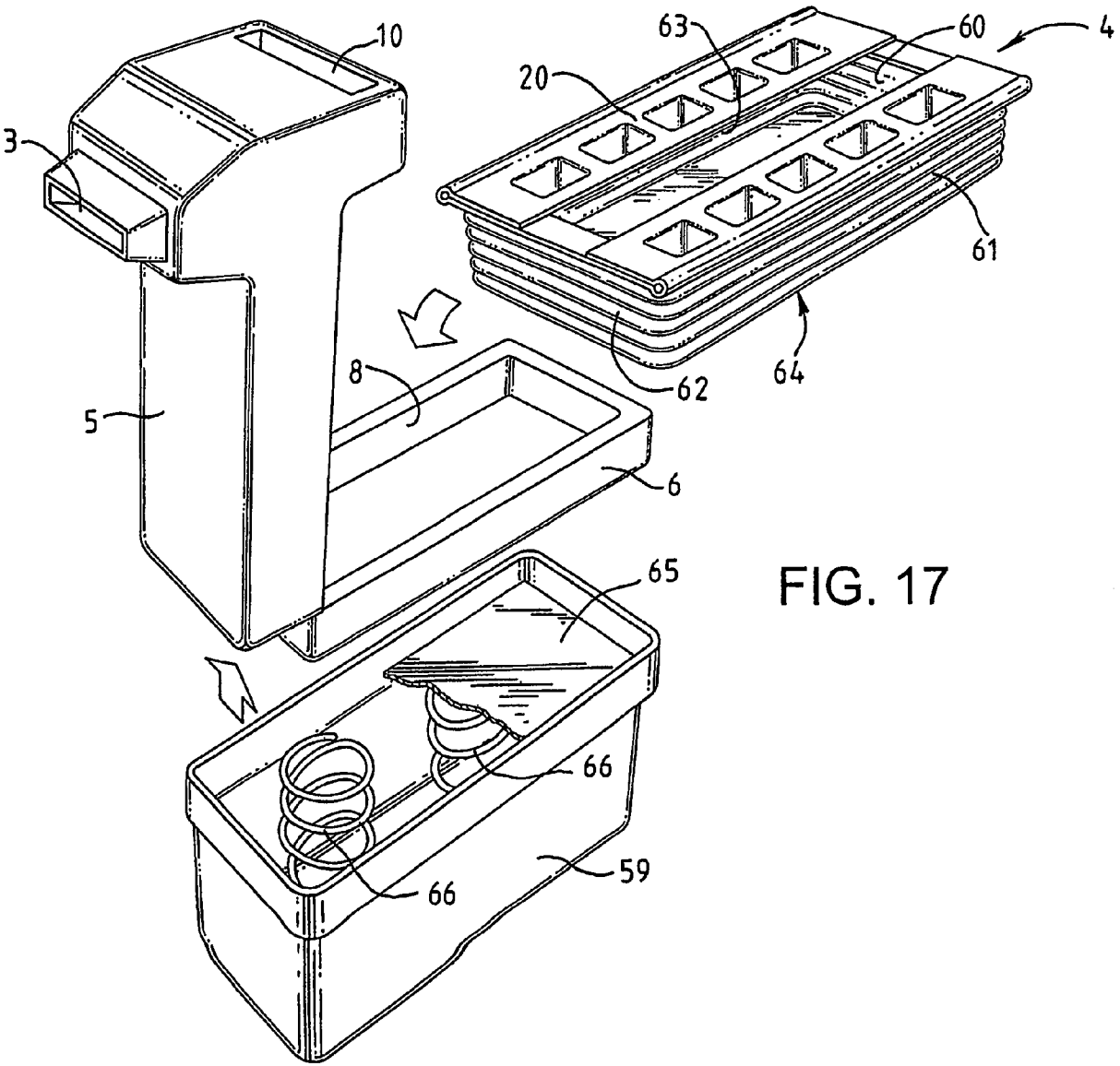
FIG. 17 is a schematic perspective view of another embodiment of the invention in which the container does not have an integral spring.

Another embodiment of the invention is shown in FIG. 17, which is generally similar to the example shown in FIGS. 1 to 3, with the modification that the container 4 does not contain an integrally moulded spring 17 in its base and instead the spring function is performed by an external loading box 59 which fits onto the underside of the frame 6.

The container 4 is integrally moulded in a plastics material and has a generally rectangular lip 7 and wings 19, 20 that function as previously described, with concertina side walls 60, 61, 62, 63 that extend to a planar base 64. The container 4 is placed in the packaging device as previously described, within the frame 6, and the loading box 59 is fitted to its underside. The concertina side walls 60-63 do not exhibit any significant spring function on the notes stacked in the container 4. Instead, the loading box 59 contains a platen 65 which is urged by compression springs 66 against the base 64 of the container 4 whilst the banknotes are being stacked therein by the packaging device 1. A closure member 9 is then inserted through inlet 10 and heat sealed onto the container 4 as previously described. The sealed container is then removed from the frame 6 and the loading box 59 for transport to a remote location where it is opened under secure conditions and then disposed of, having performed its useful function and no longer being capable of receiving a stack of banknotes from the packaging device 1.

Figure 18:
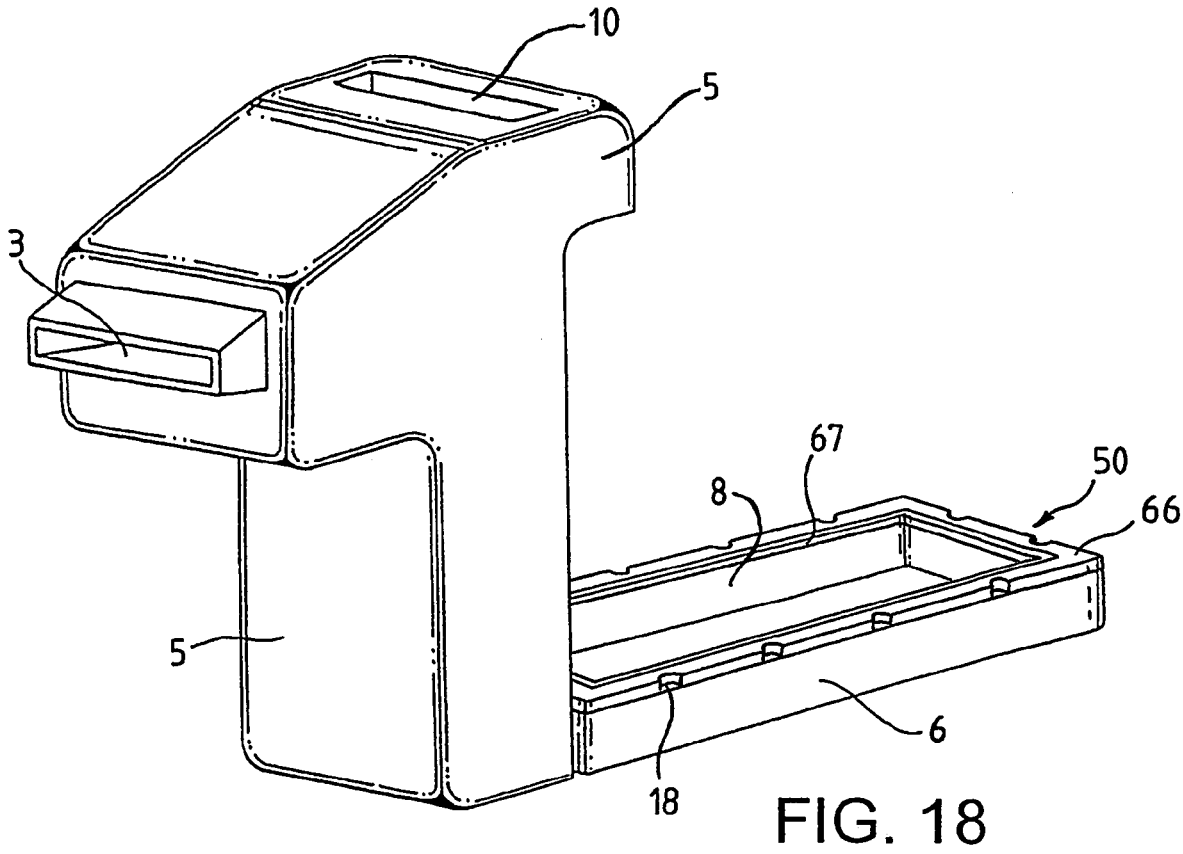
FIG. 18 is a schematic perspective view of another embodiment of packaging device according to the invention, with a printed circuit heater.
Figure 19:
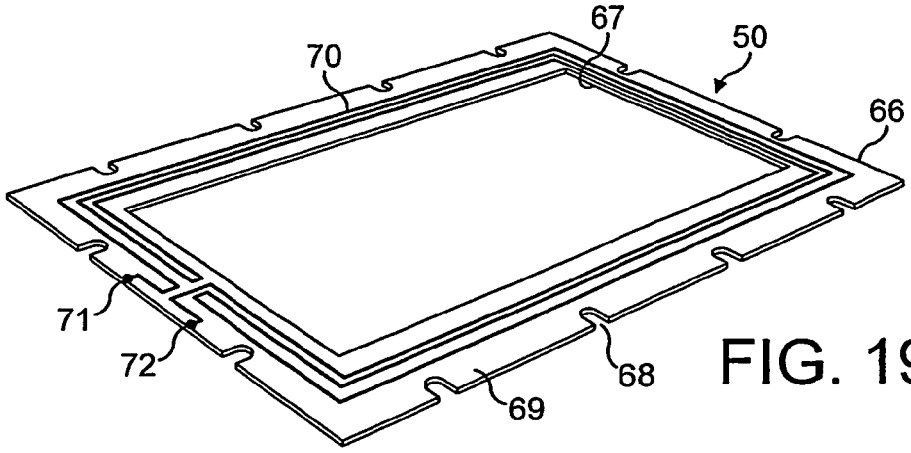
FIG. 19 is an enlarged view of the heater shown in FIG. 18.

FIG. 18 illustrates another embodiment of packaging device according to the invention in which the heater 50 that seals the container 4 is mounted on the frame 6. The heater 50 comprises a printed circuit coil illustrated in more detail in FIG. 19 and includes a generally rectangular printed circuit substrate 66 with a central opening 67 corresponding to the output port 8 shown in FIG. 18. The substrate 66 is provided with side edge detents 68 which receive hinges of the container, as will be described later. The underside 69 of the substrate 66 is glued or otherwise attached to the frame 6 shown in FIG. 18. The substrate 66 is provided with a printed circuit conductor 70 configured as a rectangular coil with terminals 71, 72 at opposite ends of its printed circuit track. In use, the terminals 71, 72 are connected to a D.C. heating current source, the supply of which is controlled by the circuitry 35 shown in FIG. 10. For example, a 12V D.C. supply can be used, with the coil provided by the conductor 70 being rated at 4 watts. When energised, the printed circuit track 70 acts as a heating element to soften and partially melt the rectangular lip 7 and wings 19, 20 so that they become sealed to one another and also to the closure member 9. In one example, the heater 50 operates at temperature of around 200-220° C. The container 4 may for example be made of polypropylene with a melting point of around 260° C. and the closure member 9 may be made of polyethylene with a melting point of 140-160° C. The heater 50 thus melts the closure member 9 onto a softened rails of the container 4 to seal the closure member 9 in place when cooled thereafter.

The substrate 66 of heater 50 may be formed of conventional fibreglass or fibre reinforced paper and the printed circuit coil may be a Ti/Cu alloy formed by conventional printed circuit fabrication techniques. The outer surfaces of the substrate 66 may be coated with a conventional solder mask layer to protect the printed circuit coil conductor 70 and it has been found according to the invention that this solder mask layer acts as a release agent which causes the sealed container 4 and closure member 9 to release from the heater element 50 after heating, facilitating removal of the sealed container 4 from the packaging device. The solder mask may comprise an epoxy acrylic resin, for example OPSR 5600 G10 Serie supplied by Elga Europe Srl of Milan, Italy. The heater element may be cut e.g. by stamping from a sheet of printed circuit substrate 66 and the portion removed from the centre can be used as the substrate for circuitry 36 shown in FIG. 8, avoiding waste.

Many modifications to this arrangement are possible. For example, the heater 50 may be mounted on the main body 5 instead of on the frame 6 or such heaters may be provided both on the body member 5 and frame 6.

Another example of the containet 4 is illustrated in FIGS. 20-25. The container is shown with its wings 19, 20 open in FIG. 20, closed in FIG. 21 and with the closure member 9 in place in FIG. 22.

Figure 20:
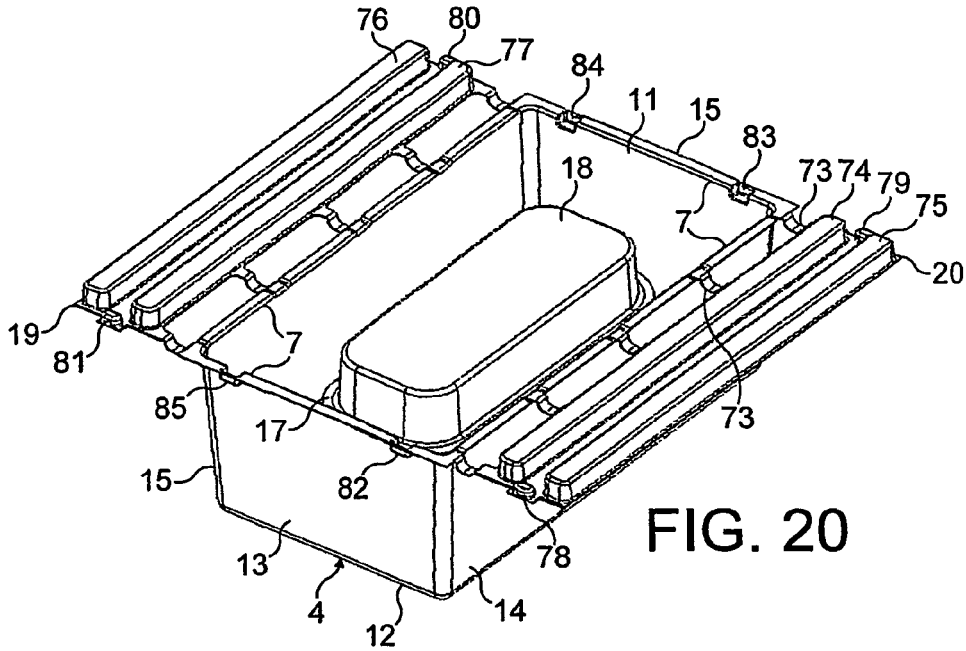
FIG. 20 is a schematic perspective view of another example of a container with its wings open.

Referring to FIG. 20, the container 4 is manufactured as a stackable, one piece moulding of thermoplastics material and comprises a generally rectangular opening 11 bounded bylip 7, base 12, sidewalls 13, 14, 15 and 16 that extend from the base to the opening 11 and the lip 7. Elongate wings 19, 20 are hingedly coupled to the lip 7 along the long sides of the container. The base 12 is moulded to include corrugations 17 that are disposed between a generally rectangular central, base support region 18 and the sidewalls 13 to 16. As previously described, the corrugations 17 act as a compression spring to urge the base support region 18 towards the opening 11 as successive banknotes are inserted into the container.

The wings 19, 20 are coupled to the lip 7 by individual, looped, spaced hinge regions 73 which hold the wings 19, 20 spaced from the lip 7 along the long sides 14, 16 of the container. Instead of using castellations as previously described, the wings 19, 20 are each provided with a pair of generally parallel elongate channel regions 74, 75, 76, 77. These channel regions act as stop against which the edges of the stacked banknotes abut when in the container.

Figure 21:
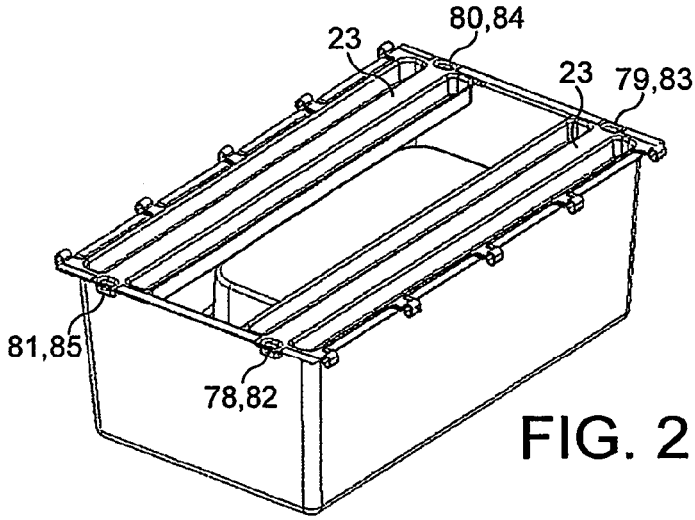
FIG. 21 corresponds to FIG. 20 with the wings closed.

The main guide surface 23 that is used to guide banknotes comprises a continuous surface between the pairs of channel regions 74, 75; 76, 77, as shown in FIG. 21.

Each of the wings 19, 20 is provided at opposite ends with closure lugs 78, 79, 80, 81, which are push-fitted into corresponding recesses 82, 83, 84 and 85 when the wings are closed, as shown in FIG. 21.

Figure 24:
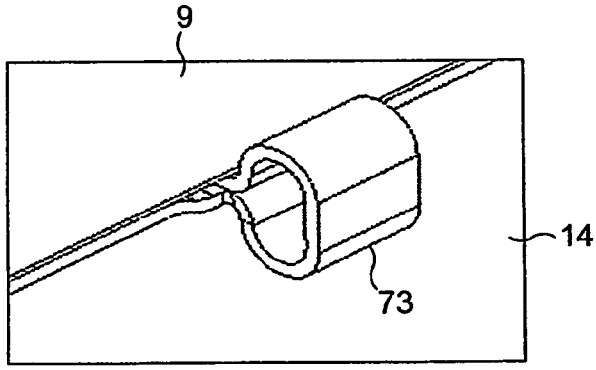
FIG. 24 illustrates a hinge of the container of FIG. 20, with the closure member sealed thereto.

It has been found that the twin channel configuration of the wings shown in FIGS. 20 and 21 provides a very effective stop against which the stacked banknotes abut when inserted into the container, with a result that no platen 21 as described with reference to FIG. 24, needs to be provided, and the base support region 18 operates effectively without such a platen to compress the stacked banknotes against the underside of the channel regions 74-77.

Figure 23:
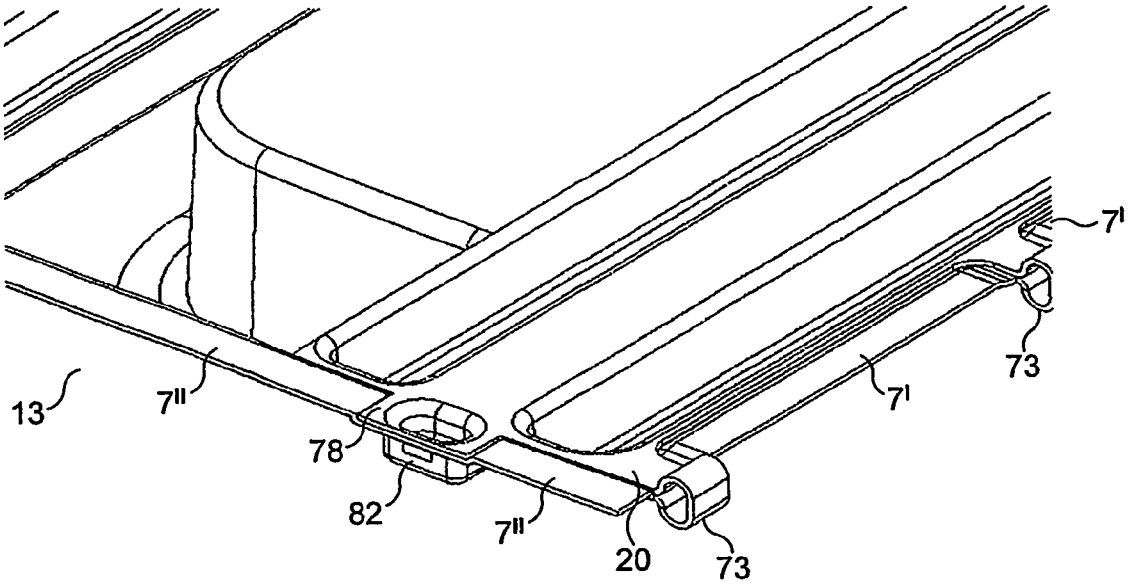
FIG. 23 is an enlarged view corresponding to FIG. 21.

FIG. 23 is an enlarged view of a portion of FIG. 21, illustrating wing 20 when closed. The lip 7 has raised portions 7' between the hinge regions 73 and raised portions 7" on either side of the recess 82, so that the lip 7 in these regions is generally coextensive with the upper surface of the closed wing 20. In this way, when the closure member 9 overlies each hinge region 73 as illustrated in FIG. 24 and also the closure lug 78 inserted into the recess 82, operation of the heater 50 causes the closure member 9 to be sealed directly onto both the upper surface of the wing 20 and also onto the lip 7 and raised portions 7' and 7", thereby creating a tamper proof seal.

Referring again to FIGS. 18 and 19, it will be seen that the recesses 68 in the heater element 50 are configured to receive the hinge regions 73 and the recesses 82-85, to allow the container to sit flush on the heater 50.

Figure 22:
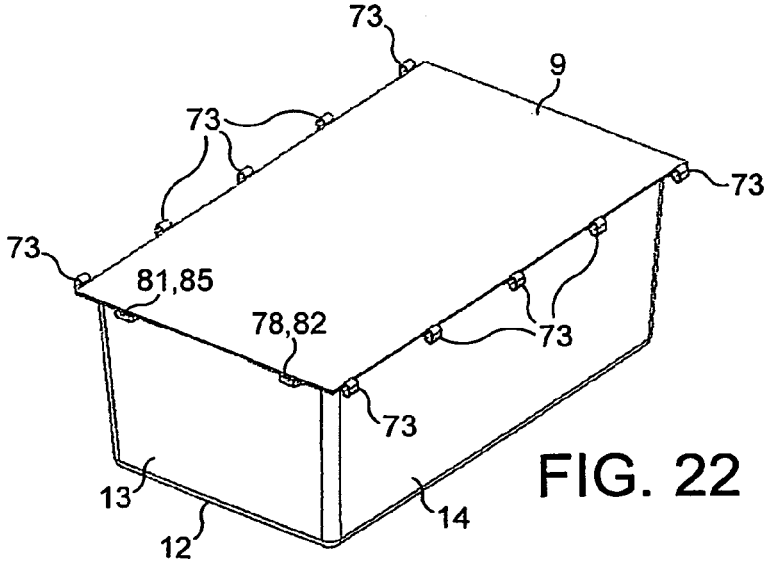
FIG. 22 illustrates the container of FIG. 20 with a closure member sealed thereto.
Figure 25:
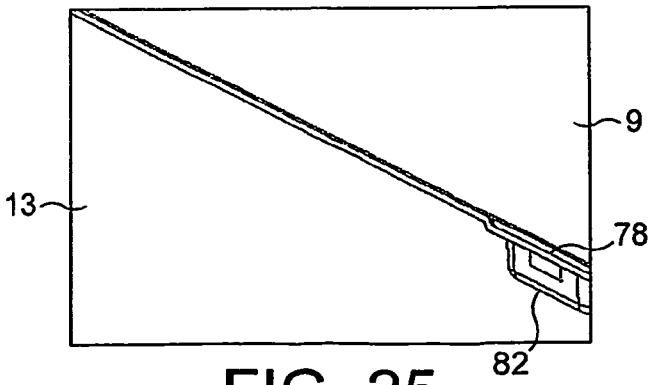
FIG. 25 illustrates the configuration of one of the closure lags when the closure member is sealed onto the container.
Figure 26:
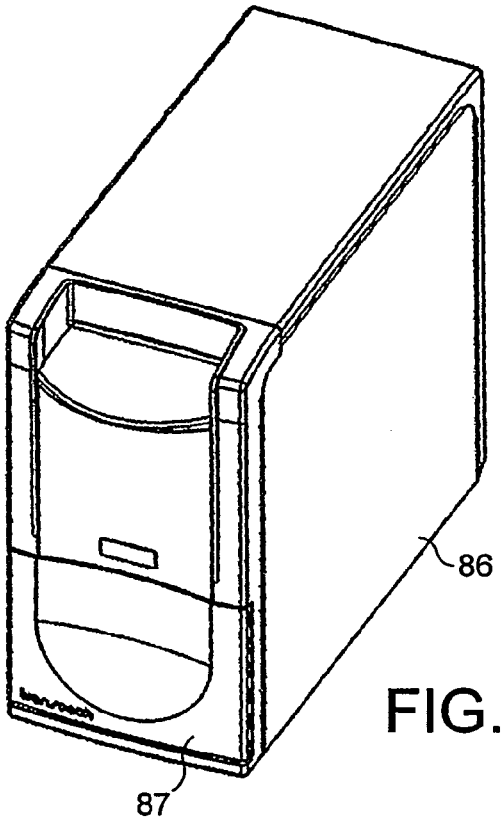
FIG. 26 is a schematic perspective view of another embodiment of the packaging device which is suited to use in supermarkets and like sales outlets.

Another embodiment of the packaging device according to the invention is illustrated in FIGS. 26 to 29, which can use the container 4 illustrated in FIGS. 22 and 25. Referring to FIG. 26, the device is for use in supermarkets and like sales outlets and can be placed under the counter near a till at a checks out location. The device consists of a generally rectangular main body 86 which contains a mechanism for loading the banknotes into the container 4 and sealing a closure member 9 onto the filled container 4. To this end, the housing 86 contains mechanisms and circuitry generally as described with reference to FIGS. 8-10, but with different a configuration of paths for the banknotes 2 and the closure member 9 to follow to the container 4. Also the manner in which the container is docked and removed from the main body 86 is somewhat different from the previously described embodiment, as will now be discussed in more detail.

Figure 27:
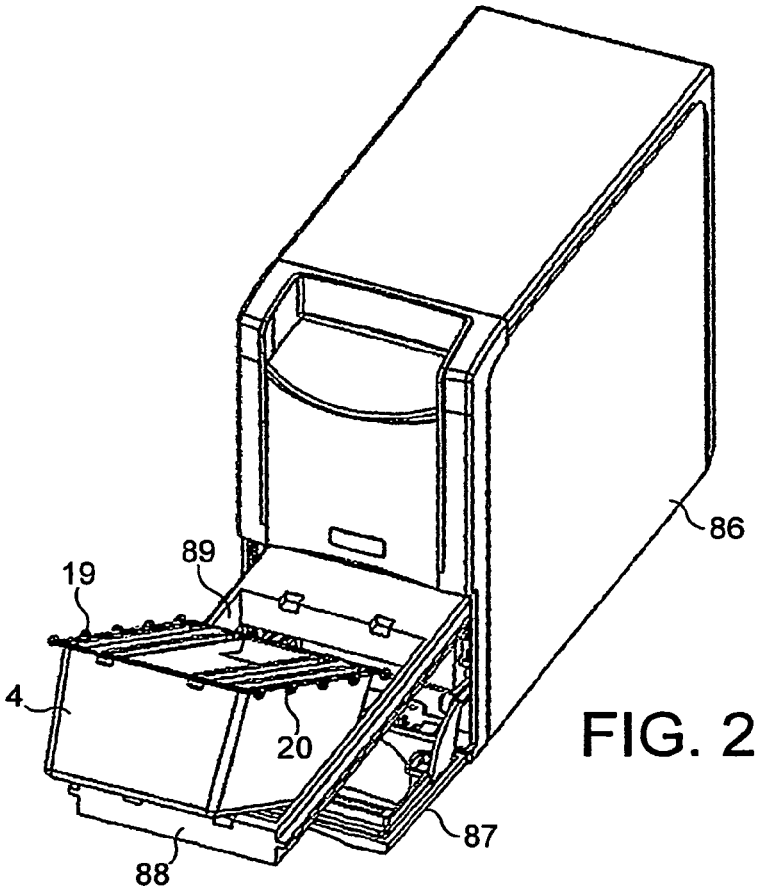
FIG. 27 illustrates the insertion or replacement of a container to receive banknotes into the device of FIG. 26.

Referring to FIG. 27, a hinged door 87 can be opened downwardly to allow a slidable tray 88 to extend outwardly of the housing 86. The tray 88 and acts as a frame into which container 4 can be inserted, with its wings 19, 20 closed. An output port in the form of a rectangular opening 89 in the tray 88 receives the container 4 in a similar manner to the frame 6 shown in FIG. 2. The container 4 is shown partially inserted in the opening 89 in FIG. 27. When fully inserted, the tray can be pushed inwardly of body 86 and the door 87 closed, in order to dock the container 4 in the main body 86, to be filled with banknotes.

Figure 28:
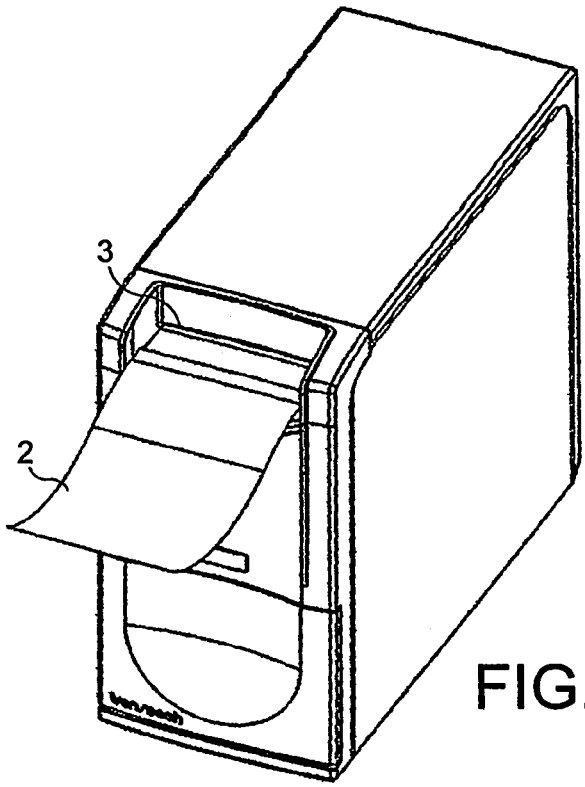
FIG. 28 illustrates the insertion of a banknote into the device shown in FIG. 26.
Figure 29:
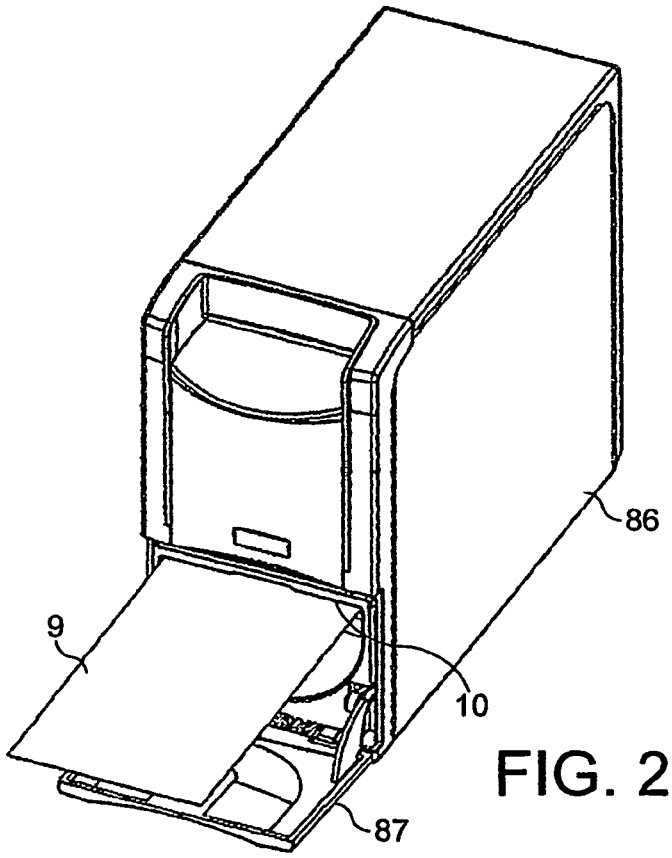
FIG. 29 illustrates the insertion of the closure member into the device shown in FIG. 26, for being sealed onto the container.

The main body 86 includes a slot 3 to receive banknote 2 as shown in FIG. 28. In use, a till operator inserts banknotes into slot 3 and they are validated and conveyed along a path within the main body 86 into the container 4 by means of a mechanism generally similar to that already described with reference to FIGS. 8 to 10.

When the container 4 becomes full of banknotes, the door 87 is opened to expose a slot 10 into which a closure member 9 for the container 4 can be inserted. A heater device as described with reference to FIGS. 8-10 then seals the closure member 9 onto the container 4 in the manner previously described. The container 4 can then be removed from the housing 86 by opening the tray 88 as illustrated in FIG. 27. The device shown in FIG. 26 may include a printed circuit heater 50 as previously described, which may be mounted on the tray 88 or within the housing 86.

Many modifications and variations of the described embodiments fall within the scope of the invention. For example, whilst the packaging of banknotes has been described, other sheet objects with an attributable monetary value can be packaged in accordance with the invention, such as tokens or coupons, which may be bar-coded, and vouchers providing a discount or other promotional scheme.

Also, instead of or in addition to the printing carried out by the print head 51, a radio frequency identification (RFID) tag may be included on or in the container 4 or the closure member 9. This may be in the form of a printed coil or other techniques may be used as known in the art such as described in WO9935610. Reference is also directed to International Standard ISO 15693 for details of a specification of RFID tags that operate in the 13.56 MHz frequency band. The tag may contain a small amount of data so that if a person attempts to take the sealed container containing the banknotes from the premises, the data can be detected using r.f. detectors to set off an alarm.

The invention claimed is:

1. A packaging device for packaging a stack of sheet objects that have an attributable monetary value in a container, comprising:

an input path for the sheet objects, an output port for supplying sheet objects to be stacked in the container, a docking mechanism to receive the container, so that an opening in the container can receive the sheet objects from the output port, a drive mechanism for driving the sheet objects to the output port, and for supplying the sheet objects through the opening into the container to be stacked therein, the drive mechanism being configured to drive the sheet objects in a direction transverse to their major faces through the output port into the container so as to create a stack of the sheet objects in the container, and a sealing device to seal a closure member onto the container opening whilst held by the docking mechanism so as to seal the stacked sheet objects within the container such that the sealed container cannot be opened without rendering it subsequently unusable for packaging sheet objects in the packaging device.

2. A device according to claim 1 including a printer to print data relating to the sheet objects supplied into the container.

3. A device according to claim 2 wherein the printer is operable to print the data onto the closure member.

4. A device according to claim 3 wherein the printer is operable to print the data onto a side of the closure member that after sealing is on the inside of the container.

5. A device according to claim 1 including first input port to receive the sheet objects, and a second input port to receive the closure member, the drive mechanism being operable to drive the objects and the closure member to the output port.

6. A device according to claim 1 including a main body and an openable frame mounted on the main body, the frame including said output port and being configured so that when opened the container can be fitted in the output port on the frame and then when mounted to the main body the container is retained between the frame and the main body.

7. A device according to claim 6 wherein the input path extends between the frame and the main body.

8. A device according to claim 6 wherein the sealing means comprises an electric heater on the main body or the frame.

9. A device according to claim 1 including a sensor to sense sheet objects and counting circuitry to count them.

10. A device according to claim 1 including discrimination circuitry to discriminate between true and false sheet objects.

11. A device according to claim 10 wherein the discrimination circuitry is operable to determine the monetary value attributable to true sheet objects.

12. A device according to claim 1 including a spring loaded platen to compress stacked sheet objects in the container.

13. A device according to claim 12 wherein the spring loaded platen is within a loading box attached to the docking mechanism.

14. A device according to claim 1 and including the container.

15. A device according to claim 14 wherein the container comprises an opening to receive the sheet objects, a base, sidewalls extending towards the opening from the base, support rails coupled to the side walls on opposite sides of the opening, past which in use the sheet objects resiliently deform when placed in the container in a stacked configuration through the output port.

16. A device according to claim 15 wherein the support rails each include a main guide surface to guide a side edge region the sheet members along the input path, and stop regions for providing a stop against which the stack of sheet objects abuts when in the container.

17. A device according to claim 15 including a spring in the base operable to urge stacked sheet objects in the container against the support rails, the container being configured to receive the closure member sealed thereto over the opening.

18. A device according to claim 17 wherein the base is integral with the sidewalls and resiliently coupled thereto to provide the spring.

19. A device according to claim 15 wherein the sidewalls have a concertina configuration.

20. A device according to claim 1 wherein the sealing device includes a printed circuit heater element to be energised by a d.c. heating current.

21. A device according to claim 1 wherein the docking mechanism includes a hinged frame.

22. A device according to claim 1 wherein the docking mechanism includes a slidable frame.

23. The device according to claim 1 further comprising a low voltage heater element comprising a printed circuit board on which is formed a heater element as a printed circuit conductive track.

24. A container for packaging sheet objects with an attributable monetary value, comprising an opening to receive the sheet objects, a base, sidewalls extending towards the opening from the base, support rails coupled to the side walls on opposite sides of the opening, the container being configured to receive a closure member sealed thereto over the opening so that the container cannot be reused for stacking sheet objects once opened, wherein the support rails are hinged for movement from a storage position exteriorly of the opening, to an operative position within the opening for guiding the sheet objects to overlie the opening and past which the sheet objects resiliently deform when placed in the container in a stacked configuration, the support rails each including a main guide surface to guide a side edge region of the sheet members to be stacked within the container, stop regions for providing a stop against which a stack of sheet objects abuts when in the container, and a coupling portion coupling said main guide surface hingedly to the said side wall.

25. A container according to claim 24 wherein the support rails comprise wings coupled by integral hinges to a lip around the opening.

26. A container according to claim 25 wherein the hinges comprise spaced hinge regions that hold the wings spaced from the lip.

27. A container according to claim 26 wherein the lip includes raised portions between the hinge regions that are coplanar with the upper side of the wings when in said operative position.

28. A container according to claim 24 wherein the stop regions comprise castellations.

29. A container according to claim 24 wherein the stop regions comprise channels in the support rails.

30. A container according to claim 24 wherein the base is integral with the sidewalls and resiliently coupled thereto to provide a spring operable to urge stacked sheet objects in the container against the support rails.

31. A container according to claim 24 wherein the sidewalls are arranged in a concertina configuration.

32. A container according to claim 24 including a platen on the base, the platen being configured to receive the stack of sheet members.

33. A container according to claim 24, integrally moulded.

34. A container according to claim 33, integrally moulded in a plastics material.

35. A container according to claim 32 wherein the platen comprises a discrete element on the base.

36. A container according to claim 32 wherein the platen is integral with the base.

37. A container according to claim 32 wherein the base includes a plurality of platen portions each resiliently biased towards the support rails.

38. A container according to claim 24 wherein a plurality thereof can stack one within the other.

39. A container according to claim 24 and including the closure member.

40. A container according to claim 39 wherein the closure member includes a line of weakness along which it can subsequently tear to facilitate removal of the sheet objects.

41. A container according to claim 39 and including the closure member sealed to the opening.

42. A container according to claim 41 wherein the closure member has been heat-sealed thereon.

43. A container according to claim 24 containing a stack of said sheet objects.

44. A container according to claim 43 wherein the sheet objects comprise banknotes or like promissory notes of attributable monetary value.

45. A container according to claim 43 wherein data relating to said stack of sheet members is printed on the closure member.

46. A container according to claim 45 wherein the data is printed on the inside of the closure member.

47. A container according to claim 24 with a RFID device.

48. A container according to claim 24 further comprising a support for the container around the periphery of its opening, ram to apply a force to the base to drive it towards the opening and to collapse the side walls and cause the sheet objects to burst open the closure member so that the sheet objects move out of the container through the opening.

49. A container according to claim 24 further comprising means for applying a force to the base of the container to drive it towards the opening and cause the sheet objects to burst open the closure member so that they move out of the container through the opening.

50. A container according to claim 24, wherein the base includes a spring to urge the stacked configuration of sheet objects against the support rails.

51. a container according to claim 24, wherein the spring comprises corrugations in the base.

* * * * *